US010767823B2

(12) United States Patent
Ticktin et al.

(10) Patent No.: US 10,767,823 B2
(45) Date of Patent: Sep. 8, 2020

(54) LED LIGHTING ASSEMBLY

(71) Applicant: CooLEDlite, Inc., Deerfield Beach, FL (US)

(72) Inventors: Peter Ticktin, Deerfield Beach, FL (US); Thomas Cartwright, Stuart, FL (US)

(73) Assignee: COOLEDLITE, INC., Deerfield Beach, FL (US)

( * ) Notice: Subject to any disclaimer, the term of this patent is extended or adjusted under 35 U.S.C. 154(b) by 0 days.

(21) Appl. No.: 16/364,796

(22) Filed: Mar. 26, 2019

(65) Prior Publication Data

US 2019/0219236 A1 Jul. 18, 2019

Related U.S. Application Data

(60) Continuation of application No. 15/407,119, filed on Jan. 16, 2017, now Pat. No. 10,240,731, which is a continuation-in-part of application No. 15/377,482, filed on Dec. 13, 2016, now abandoned, which is a division of application No. 14/701,127, filed on Apr. 30, 2015, now Pat. No. 9,518,723, which is a continuation-in-part of application No. 13/820,695, filed as application No. PCT/US2012/032660 on Apr. 7, 2012, now Pat. No. 9,052,417.

(60) Provisional application No. 61/553,011, filed on Oct. 28, 2011, provisional application No. 61/473,576, filed on Apr. 8, 2011.

(51) Int. Cl.

| | |
|---|---|
| ***F21S 8/02*** | (2006.01) |
| ***F21V 21/22*** | (2006.01) |
| ***F21V 29/83*** | (2015.01) |
| ***F21K 9/232*** | (2016.01) |
| ***F21V 29/77*** | (2015.01) |
| ***F21K 9/235*** | (2016.01) |
| ***F21K 9/237*** | (2016.01) |
| ***F21V 23/06*** | (2006.01) |
| ***F21V 21/002*** | (2006.01) |
| *F21Y 115/10* | (2016.01) |

(52) U.S. Cl.

CPC ..... *F21S 8/026* (2013.01); *F21K 9/232* (2016.08); *F21K 9/235* (2016.08); *F21K 9/237* (2016.08); *F21S 8/028* (2013.01); *F21V 21/002* (2013.01); *F21V 21/22* (2013.01); *F21V 23/06* (2013.01); *F21V 29/773* (2015.01); *F21V 29/83* (2015.01); *F21Y 2115/10* (2016.08)

(58) Field of Classification Search

CPC ..... F21S 8/028; F21V 21/22

See application file for complete search history.

(56) References Cited

U.S. PATENT DOCUMENTS

2012/0236580 A1* 9/2012 Cheng ..... F21V 29/00 362/387

* cited by examiner

*Primary Examiner* — Sean P Gramling

(74) *Attorney, Agent, or Firm* — The Concept Law Group, PA; Scott D. Smiley; Scott M. Garrett

(57) ABSTRACT

A mount for an LED lighting assembly includes a length adjusting shaft having releasable engagement features that allow the length to be adjusted to a desired length, but also the be released and readjusted as needed. The length adjusting shaft can include an external release disposed outside the housing of the LED lighting assembly that is coupled to the releasable engagement and is configured to release the releasable engagement from the adjustment features through a housing of the LED lighting assembly.

19 Claims, 14 Drawing Sheets

200

200

LED LIGHTING ASSEMBLY

CROSS-REFERENCE TO RELATED APPLICATION

This Non-provisional Utility Application is a Continuation of co-pending U.S. Non-provisional patent application Ser. No. 15/407,119, filed on Jan. 16, 2017, which is a Continuation-in-part of U.S. Non-provisional patent application Ser. No. 15/377,482, filed on Dec. 13, 2016, which is a Divisional Application of U.S. Non-provisional patent application Ser. No. 14/701,127, filed on Apr. 30, 2015, now issued as U.S. Pat. No. 9,518,723, which is a Continuation-in-part Application of U.S. Non-provisional patent application Ser. No. 13/820,695, filed on Mar. 4, 2013, now issued as U.S. Pat. No. 9,052,417, which is a 371 National Stage Entry of International PCT Application No. PCT/US2012/32660, filed Apr. 7, 2012, which claims priority to U.S. Provisional Patent Application No. 61/473,576, filed Apr. 8, 2011 and U.S. Provisional Patent Application No. 61/553,011, filed Oct. 28, 2011, the entireties of which are all hereby incorporated by reference.

FIELD OF THE INVENTION

The present invention relates generally to LED lighting assemblies, and, more particularly, relates to an LED lighting assembly with a plurality of heat dissipating fins and/or a length adjusting shaft for the LED lighting assembly.

BACKGROUND OF THE INVENTION

Existing light-emitting diode (LED) lights have become increasingly popular because they are known to be generally energy efficient, as compared to incandescent lights, and provide a high quality brightness and color. Further, LED lights are known to have a generally higher life expectancy as compared to incandescent lights. As an example, many newer LED lights have a life span of about 30,000 hours, compared to an estimated 7,500 hours for a compact fluorescent bulb and 1,000 hours for an incandescent bulb.

However, the environment in which the LEDs operate is important to their longevity. LEDs are semiconductor devices that, like most semiconductors, will degrade from excessive heat. LEDs and their drivers (i.e., electrical components) will degrade and operate less efficiently if exposed to heat gain and/or excessive temperature fluctuations. LEDs have been known to flicker, dim, or not work at all in extreme temperatures. In fact, exposure to too much heat has been considered one of the primary reasons for the failure of many LED lights. Accordingly, heat gain and excessive temperature fluctuations will decrease the life expectancy of the LED and tend to negate at least some of the positive benefits associated with LEDs.

Some known LED lighting structures require the presence of one or more fans that constantly run and pull air from the environment into the lighting structure and across a set of heat dissipating heat-sink fins. These fans require energy, add weight and cost to the lighting device, provide a point of potential electrical failure (which can serious damage the remaining components that will become too hot), and create noise.

LED lighting devices and systems have come into widespread use in homes and buildings. Known LED structures for regular ambient lighting currently dissipate heat by exposing one or more portions of the LED structure to atmospheric conditions. Some known LED lighting assemblies also expose portions, e.g., the power supply and/or driver/controller circuit, if applicable, to the atmosphere as those portions of LEDs also generate heat. In addition, a limited number of LED lighting assemblies have one or more heat sinks attached thereto to facilitate the dissipation of heat through convection. Many such LED lighting assemblies with heat sinks expose the heat sinks to the atmosphere to dissipate heat into the atmosphere. However the form, and although having a generally longer life than traditional bulbs, these known LEDs, when ran for normal periods of time, experience a drastic reduction in bulb intensity.

This is specifically applicable when LED lighting assemblies are obstructed or placed in enclosed spaces where hot air is not easily exchanged with cooler air. One example of this is LED lighting structures placed within a recessed lighting "can." When an LED light is placed within small or enclosed areas, the space surrounding the LED bulbs is not cooled and much of the generated heat from the bulbs remains in that area. This effect is shown in FIG. 1, which illustrates a prior-art LED lighting assembly 100 within a recessed portion 104 of a ceiling 102. The hot air, represented with arrows 106, is not effectively dissipated and continually subjects the assembly 100 to air at high temperatures. As the LED assembly 100 is continually subjected to high temperatures, the lifespan of the assembly 100 is reduced and the probability of heat-related malfunctions is increased. This also renders any heat sinks 108 coupled to those prior-art assemblies 100 to be ineffective and inefficient as they still suffer from the same problems as described above, i.e. the LED assembly 100 is still subjected to previously dissipated heat.

Furthermore, as LED lighting technology is still being developed or has increased manufacturing costs, when compared to those prior-art lighting assemblies, those costs are generally placed on the consumer. As such, LED lighting assemblies can range anywhere from three to ten times more per unit price than for traditional lighting assemblies, such as incandescent light bulbs. Many users dilute those additional initial up-front costs with the continued energy savings associated with LEDs. Therefore, most users desire to maintain the LED lighting assembly lifespan as long as possible to maximize cost efficiency.

In addition, recessed lighting cans within ceilings include varying dimensions. More particularly, such cans have varying depths between the height of the socket for the bulb and the level of the ceiling. Lighting fixtures currently provided have various distances between the sockets, which accept the bulbs, and the ceiling heights. This makes little or no difference if a bulb is inserted. However, if there is a retrofit or new light which is applied and which needs to be flush or partially flush with the ceiling, fixed length shafts between the fixed socket and the lighting appliance are inconvenient. Therefore, for lighting fixtures that are intended to hang relative to the cans at a desired position relative to the ceiling, users must select a lighting fixture with a desired length, which cannot be selectively varied to accommodate recessed lighting cans with varying recess depths.

Therefore, a need exists to overcome the problems with the prior art as discussed above.

SUMMARY OF THE INVENTION

The invention provides an LED lighting assembly that overcomes the hereinafore-mentioned disadvantages of the heretofore-known devices and methods of this general type.

In accordance with some embodiments of the disclosure, there is provided a mount for an LED lighting assembly for a recessed ceiling can that includes a length adjusting shaft having adjustment features formed on the shaft, and an electrical contact portion disposed at a first end of the length adjusting shaft. The electrical contact portion is electrically couplable with a light-bulb outlet disposed within the ceiling recess can and is electrically coupled to provide power to the LED lighting assembly. The housing can move along the shaft and includes a releasable engagement for engaging one of the adjustment features. There can also be included an external release disposed outside the housing that is coupled to the releasable engagement and configured to release the releasable engagement from the one of the adjustment features.

In accordance with another feature, the adjustment features comprise a plurality of slots formed in the shaft, and the releasable engagement comprises a shaft having a first end that engages the one of the slots to hold the housing in place relative to the shaft, and the external release comprises a button coupled to a second end of the shaft.

In accordance with another feature, the adjustment features comprise a plurality of notches formed in the shaft, and the releasable engagement comprises a shaft having a first end having a hook that is configured to engage the notches to hold a housing of the LED lighting assembly in place relative to the shaft, and the external release comprises a lever coupled to a second end of the shaft that is configured to release the hook from engagement with the notches to allow the housing to be moved downward along the shaft.

In accordance with another feature, a housing of the LED lighting assembly includes a trim portion above a sidewall portion, and a plurality of air flow exhaust ports are defined by the trim portion.

In accordance with another feature, an outer periphery of a housing of the LED lighting assembly has a concave outer surface, when viewed from an outside environment, shaped to direct the continuous flow of air away from the ceiling recess can when the electrical contact portion is coupled to the light-bulb outlet.

In accordance with another feature, a housing of the LED lighting assembly includes a circumferential skirt coupled to a radially outermost edge of each of a plurality of heat dissipating fins in the LED lighting assembly so as to define each of a plurality of air flow channels.

In accordance with another feature, a housing of the LED lighting assembly includes a trim portion and a sidewall portion, the housing defines a circumferential gap at least one of between the trim portion and the sidewall portion and defined by the trim portion, the circumferential gap operable as a main exhaust port guiding a flow of air into an outside environment.

In accordance with some embodiments of the disclosure, there is provided a mount for an LED lighting assembly for a ceiling recess can, the LED lighting assembly having a housing having an outer periphery configured to fit flush against a surface of a ceiling in which the ceiling recess can is mounted, the mount includes a length adjusting shaft having adjustment features formed on the shaft that are configured to releasably retain the housing on the shaft. The mount further includes a releasable engagement for engaging one of the adjustment features, and an external release disposed outside the housing that is coupled to the releasable engagement and configured to release the releasable engagement from the one of the adjustment features.

In accordance with another feature, the adjustment features comprise a plurality of slots formed in the shaft, and the releasable engagement comprises a shaft having a first end that engages the one of the slots to hold the housing in place relative to the shaft, and the external release comprises a button coupled to a second end of the shaft.

In accordance with another feature, the adjustment features comprise a plurality of notches formed in the shaft, and the releasable engagement comprises a shaft having a first end having a hook that is configured to engage the notches to hold a housing of the LED lighting assembly in place relative to the shaft, and the external release comprises a lever coupled to a second end of the shaft that is configured to release the hook from engagement with the notches to allow the housing to be moved downward along the shaft.

In accordance with another feature, the housing includes a trim portion above a sidewall portion and the at least one LED, and at least one of the air flow exhaust ports is defined by the trim portion.

In accordance with another feature, an electrical contact portion electrically couplable with a light-bulb outlet disposed within the ceiling recess can and electrically coupled to power the LED lighting assembly, and wherein an outer periphery of the housing has a concave outer surface, when viewed from an outside environment, shaped to direct a continuous flow of air away from the ceiling recess can when the electrical contact portion is coupled to the light-bulb outlet.

In accordance with another feature, the housing includes a circumferential skirt to define a the plurality of air flow channels.

In accordance with another feature, the housing is disposed to visually conceal each of a plurality of heat dissipating fins inside the LED lighting assembly from an outside environment.

In accordance with another feature, the housing includes a trim portion and a sidewall portion, the trim portion disposed above the sidewall portion and extending radially away the sidewall portion and a main exhaust port opening formed as a circumferential gap between the trim portion and the sidewall portion.

In accordance with some embodiments of the disclosure, there is provided a mount for an LED lighting assembly for connecting to and covering a recessed ceiling can, the LED lighting assembly having a housing include at least one LED, the mount includes a length adjusting shaft having adjustment features formed on the shaft that are configured to releasably retain the housing on the shaft, and a releasable engagement for engaging one of the adjustment features. The mount further includes an external release disposed outside the housing that is coupled to the releasable engagement and configured to release the releasable engagement from the one of the adjustment features. The housing is configured to fit flush against a surface of a ceiling in which the ceiling recess can is mounted and wherein the housing is sized to cover the recessed ceiling can.

In accordance with another feature, the adjustment features comprise a plurality of slots formed in the shaft, and the releasable engagement comprises a shaft having a first end that engages the one of the slots to hold the housing in place relative to the shaft, and the external release comprises a button coupled to a second end of the shaft.

In accordance with another feature, the adjustment features comprise a plurality of notches formed in the shaft, and the releasable engagement comprises a shaft having a first end having a hook that is configured to engage the notches to hold the housing in place relative to the shaft, and the external release comprises a lever coupled to a second end of the shaft that is configured to release the hook from engagement with the notches to allow the housing to be moved downward along the shaft.

In accordance with another feature, the housing comprised an airflow intake port and an air flow exhaust port, and at least one airflow channel within the housing around the at least one LED, and wherein the airflow intake port and the airflow exhaust port are configured so that heat produced by the at least one LED creates an airflow such that air from outside the housing is drawn into the air flow intake port, through the at least one airflow channel, and out of the air flow exhaust port.

Although the invention is illustrated and described herein as embodied in an LED lighting assembly, it is, nevertheless, not intended to be limited to the details shown because various modifications and structural changes may be made therein without departing from the spirit of the invention and within the scope and range of equivalents of the claims. Additionally, well-known elements of exemplary embodiments of the invention will not be described in detail or will be omitted so as not to obscure the relevant details of the invention.

Other features that are considered as characteristic for the invention are set forth in the appended claims. As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one of ordinary skill in the art to variously employ the present invention in virtually any appropriately detailed structure. Further, the terms and phrases used herein are not intended to be limiting; but rather, to provide an understandable description of the invention. While the specification concludes with claims defining the features of the invention that are regarded as novel, it is believed that the invention will be better understood from a consideration of the following description in conjunction with the drawing figures, in which like reference numerals are carried forward. The figures of the drawings are not drawn to scale.

Before the present invention is disclosed and described, it is to be understood that the terminology used herein is for the purpose of describing particular embodiments only and is not intended to be limiting. The terms "a" or "an," as used herein, are defined as one or more than one. The term "plurality," as used herein, is defined as two or more than two. The term "another," as used herein, is defined as at least a second or more. The terms "including" and/or "having," as used herein, are defined as comprising (i.e., open language). The term "coupled," as used herein, is defined as connected, although not necessarily directly, and not necessarily mechanically. The term "providing" is defined herein in its broadest sense, e.g., bringing/coming into physical existence, making available, and/or supplying to someone or something, in whole or in multiple parts at once or over a period of time.

As used herein, the terms "about" or "approximately" apply to all numeric values, whether or not explicitly indicated. These terms generally refer to a range of numbers that one of skill in the art would consider equivalent to the recited values (i.e., having the same function or result). In many instances these terms may include numbers that are rounded to the nearest significant figure. In this document, the term "longitudinal" should be understood to mean in a direction corresponding to an elongated direction of the shaft from a bottom end to a top end.

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and explain various principles and advantages all in accordance with the present invention.

DETAILED DESCRIPTION

Figure 1:
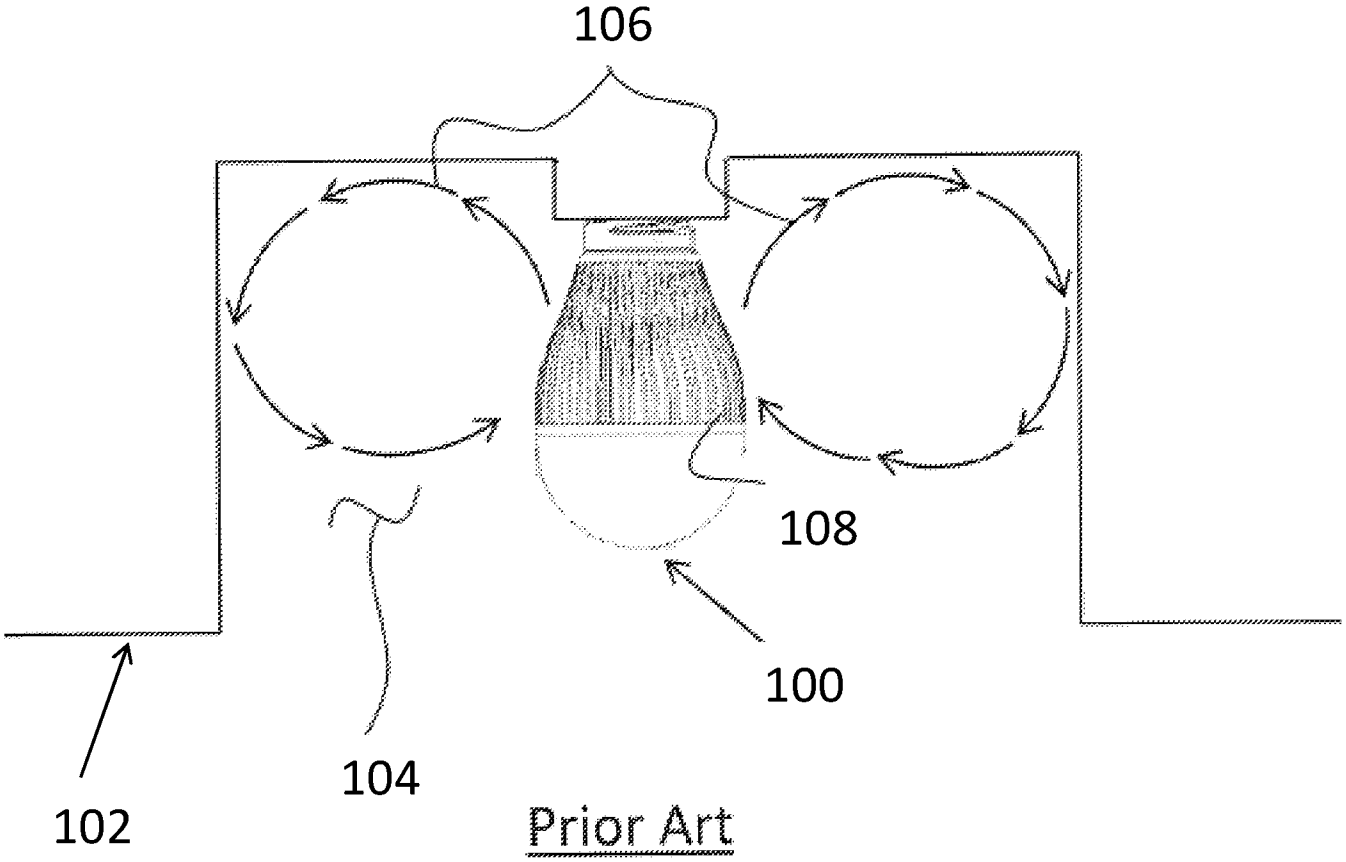
Prior Art FIG. 1
FIG. 1 is a front elevational view of a prior-art LED light assembly recessed within a ceiling can.

While the specification concludes with claims defining the features of the invention that are regarded as novel, it is believed that the invention will be better understood from a consideration of the following description in conjunction with the drawing figures, in which like reference numerals are carried forward. It is to be understood that the disclosed embodiments are merely exemplary of the invention, which can be embodied in various forms.

The present invention provides a novel and efficient ceiling mounted LED lighting assembly with a cooling feature that continuously cools the LEDs without a fan and directs hot air away from a recessed ceiling can. Embodiments of the invention provide a heat sink formed as a skirt disposed around a periphery of the LEDs and that is disposed between the LEDs and an outer periphery of a housing of the LED lighting assembly. In addition, embodiments of the invention provide for the heat sink fins and the housing to define a plurality of air flow channels disposed around the LEDs such that heat generated by the LEDs is transferred to the heat sink fins, driving a continuous flow of air through the air flow channels. In such embodiments, lower portions of the heat sink fins and housing may be considered air flow intake ports and upper portions of the heat sink fins and housing may be considered air flow exhaust ports. Embodiments of the present invention provide for the outer periphery of the housing to have a dimension exceeding a maximum opening dimension of a standard-sized recessed ceiling can, with the air flow channels disposed beneath the ceiling, in an installed configuration, and arranged to direct hot air away from the recessed ceiling can so as not to trap the hot air within the recess. Further embodiments of the present invention provide for a surface of the housing and heat sink fins having a concave shape that guides the hot air away from the LED lighting assembly and the recessed ceiling can. In additional embodiments, the LED lighting assembly includes a trim above a sidewall portion, the trim and the sidewall portion together defining a main exhaust port extending continuously, circumferentially between the trim and the sidewall portion to permit the continuous flow of hot air to escape into the atmosphere in a generally horizontal direction away from the LED lighting assembly and the recessed ceiling can. Yet other embodiments of the present invention, including an adjustable length shaft with a resistance member.

Figure 2:
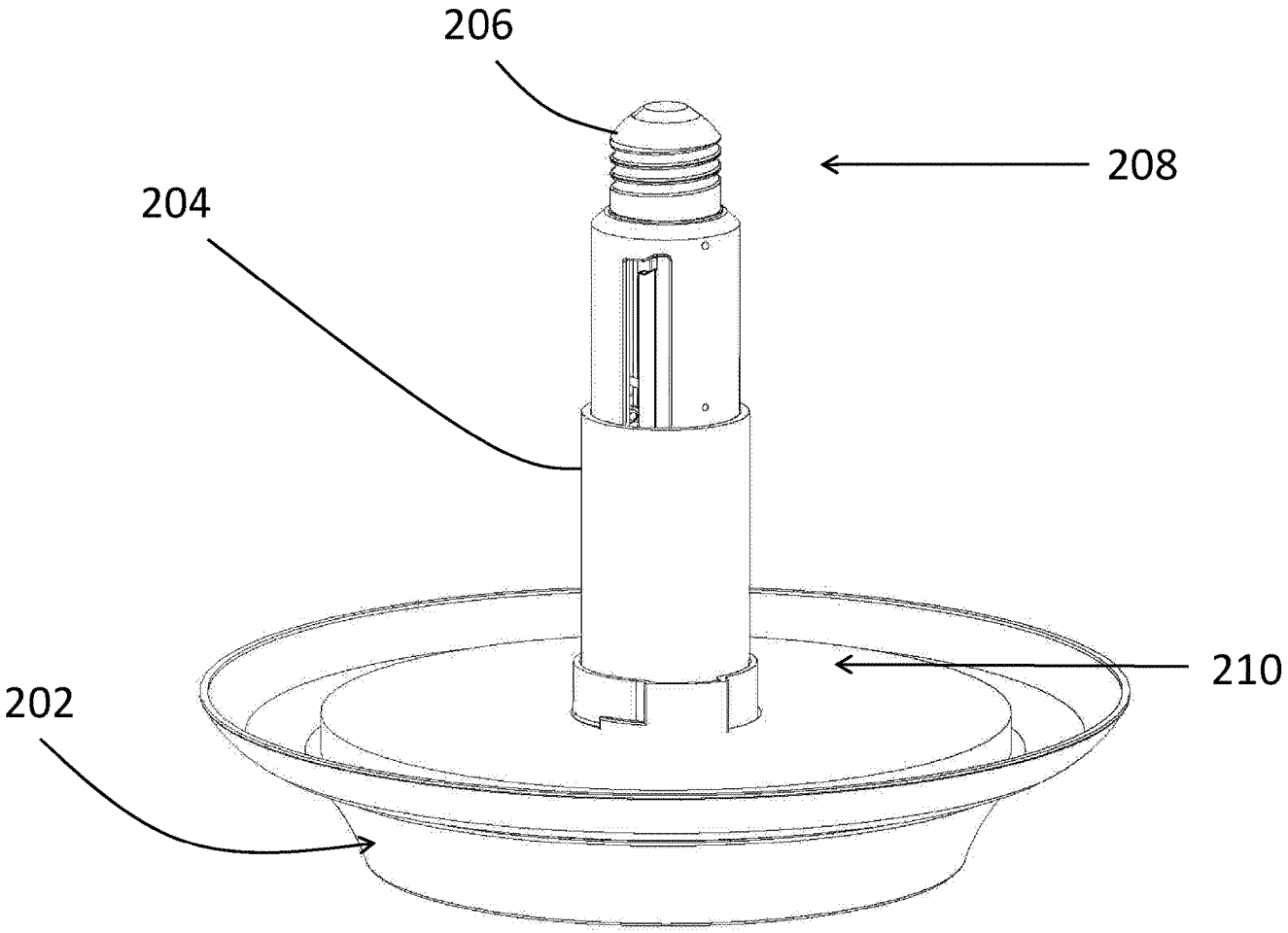
FIG. 2 is a downward-looking perspective view of an LED lighting assembly featuring an LED lamp coupled to a shaft in accordance with the present invention.

Referring now to FIG. 2, one embodiment of the present invention is shown in a downward-looking perspective view. FIG. 2 show several advantageous features of the present invention, but, as will be described below, the invention can be provided in several shapes, sizes, combinations of features and components, and varying numbers and functions of the components. The first example of an LED lighting assembly 200, as shown in FIG. 2, includes an LED lamp 202 and a shaft 204.

In one embodiment, the LED lamp 202 and the shaft 204 may be removeably coupled to one another. In other embodiments, the LED lamp 202 and the shaft 204 may be fixedly coupled to one another. In a further embodiment, the LED lamp 202 and the shaft 204 may be selectively electrically and mechanically couplable to one another, with the LED lamp 202 including the LEDs and the shaft 204 including an electrical contact portion 206 operably configured to mechanically and electrically couple to a light socket with the recessed ceiling can. The shaft 204 is preferably an adjustable length shaft 204 and embodiments of the adjustable length shaft 204 provide novel and inventive features for mounting the LED lighting assembly 200 to the ceiling, which will be described in more detail herein below. Initially, the features of the self-cooling LED lamp 202 will be described.

Figure 3:
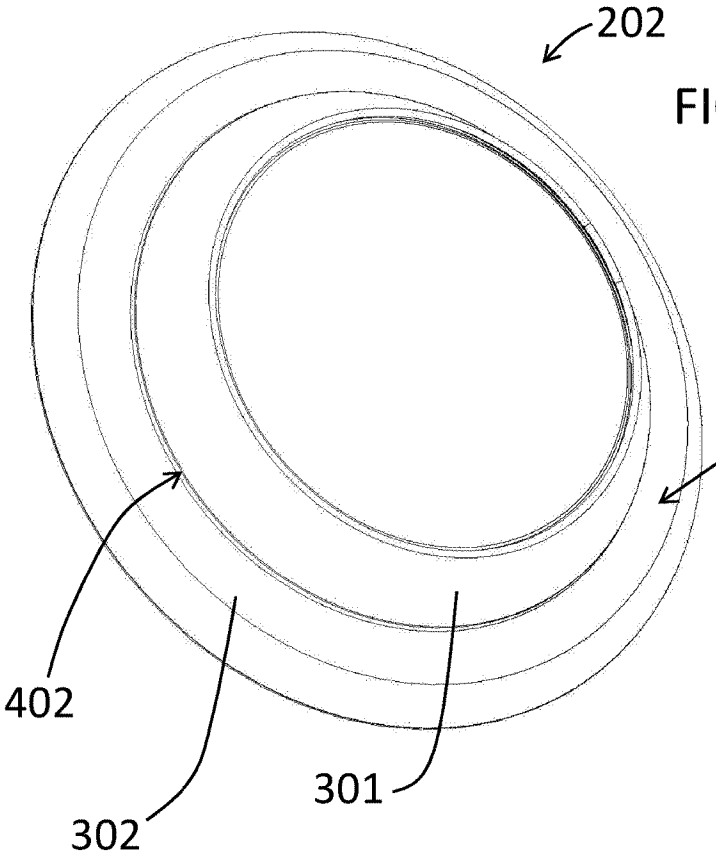
FIG. 3 is a bottom perspective view of the LED lamp of FIG. 2, illustrating a light-emitting surface, and an outer periphery of a sidewall portion and a trim portion of the housing, in accordance with the present invention.
Figure 4:
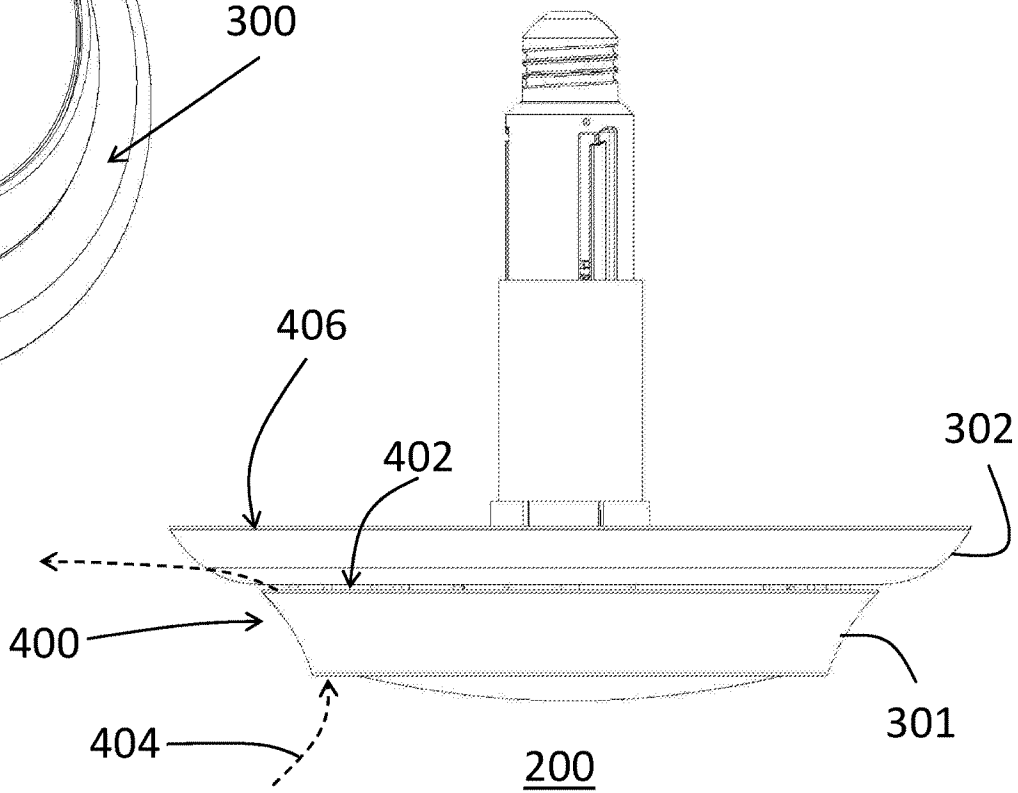
FIG. 4 is a side elevational view of the LED lighting assembly of FIG. 2 illustrating a main exhaust port in accordance with the present invention.
Figure 13:
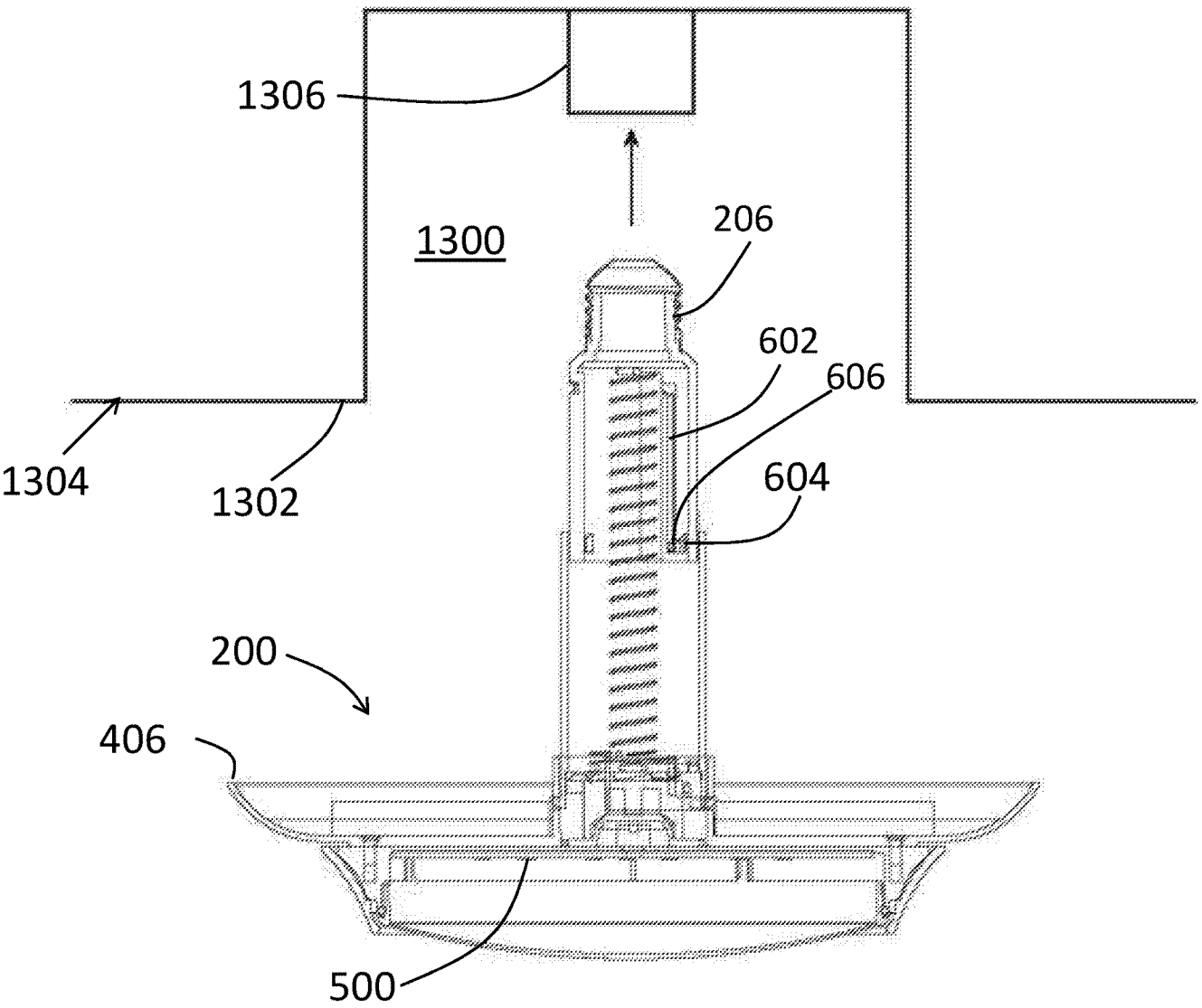
FIG. 13 is a side elevational, cross-sectional view of the LED lighting assembly of FIG. 2 being installed by insertion within a recessed ceiling can in accordance with the present invention.
Figure 14:
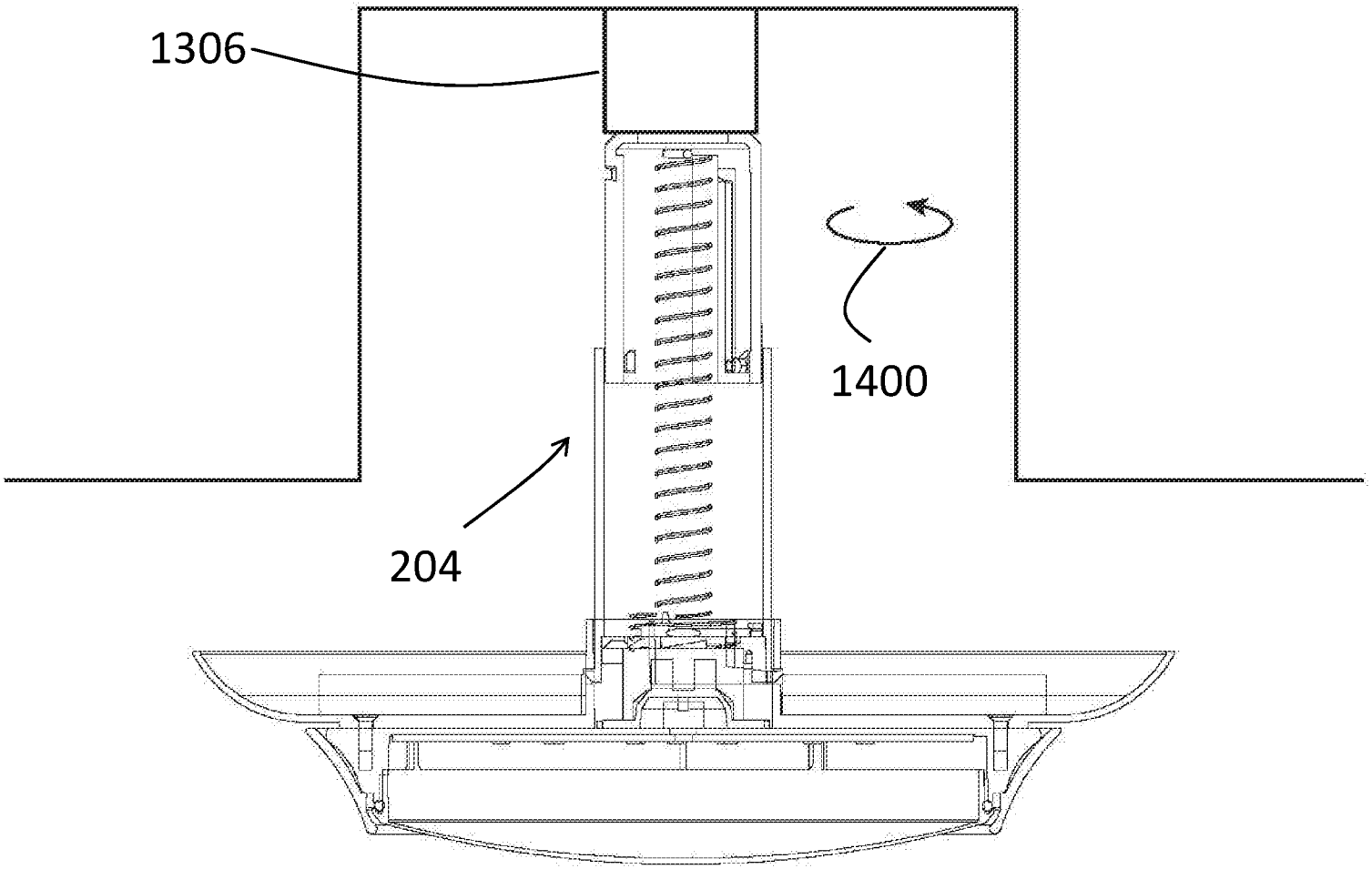
FIG. 14 is a side elevational, cross-sectional view of the LED lighting assembly of FIG. 2 being installed by coupling the shaft to a light socket within the recessed ceiling can in accordance with the present invention.
Figure 15:
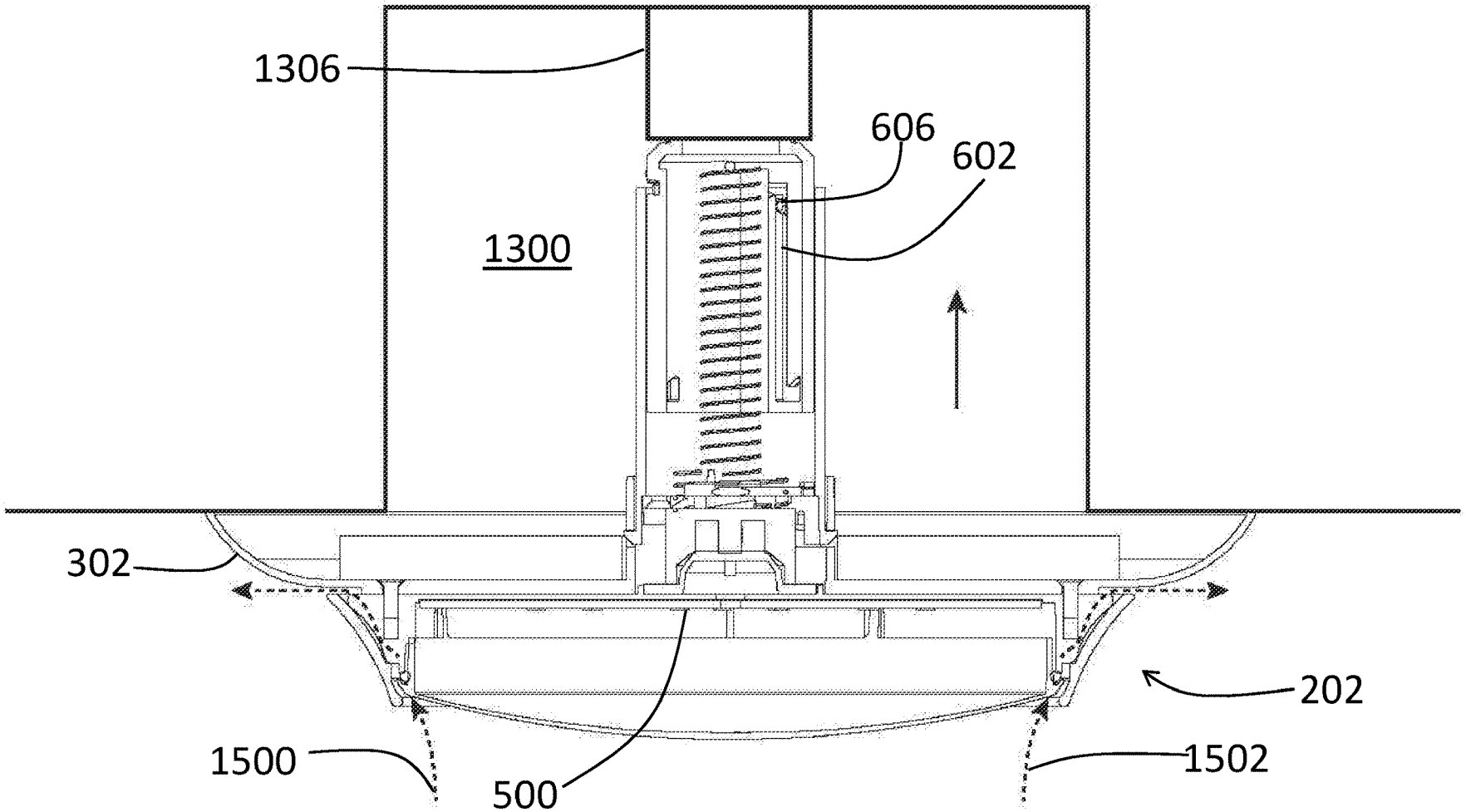
FIG. 15 is a side elevational, cross-sectional view of the LED lighting assembly of FIG. 2 installed on the recessed ceiling can in accordance with the present invention.

Referring specifically now to FIGS. 2-4, with brief reference to FIGS. 13-15, in one embodiment, the self-cooling LED lamp 202 includes a housing 300. The housing 300 may include a sidewall portion 301 and a trim portion 302. In one embodiment, an outer periphery 400, or exterior surface, of the housing 300 may have a dimension that exceeds a maximum opening dimension of a standard-sized light bulb ceiling recess 1300. Accordingly, such dimension of the outer periphery 400 may permit the LED lighting assembly 200 to be flush mounted to a surface of the ceiling 1302, beneath the standard-sized light bulb ceiling recess 1300, as can been in FIG. 15.

In one embodiment, the outer periphery 400 may be considered to be an exterior surface of the trim portion 302 and the trim portion 302 may have a maximum dimension that exceeds the maximum opening dimension of the standard-sized light bulb ceiling recess 1300. In another embodiment, the outer periphery 400 may be an exterior surface of the sidewall portion 301 and the sidewall portion 301 may have a maximum dimension that exceeds the maximum opening dimension of the standard-sized light bulb ceiling recess 1300. Yet, another portion of the outer periphery 400 of the housing 300 may have a dimension that exceeds the maximum opening dimension of the standard-sized light bulb ceiling recess 1300. As can be seen in FIG. 15, the trim portion 302 has a dimension exceeding the maximum opening dimension of the standard-sized light bulb ceiling recess 1300, thereby abutting the surface of the ceiling 1302. In yet other embodiments, both the sidewall portion 301 and the trim portion 302 may have dimensions exceed the maximum opening dimension of the standard-sized light bulb ceiling recess 1300. In additional embodiments, yet other portions of the LED lamp 202 may correspond to the outer periphery 400 that exceeds the maximum opening dimension of the standard-sized light bulb ceiling recess 1300. Such feature advantageously closes off the standard-sized light bulb ceiling recess 1300, when installed in certain embodiments (see FIG. 15, for example), such that the self-cooling feature guides hot air away from the recess 1300 and the LED lamp 202, in a generally horizontal direction, without recirculating the same hot air in the same area, as described herein above with reference to the prior art devices depicted in FIG. 1.

Referring now primarily to FIGS. 5-8, the LED lighting assembly 200 includes at least one LED 500. Preferably, the LED lighting assembly 200 includes a plurality of LEDs 500. The LEDs 500 may be any known type of LEDs and therefore the specific details of the LED construction are not necessary for the instant discussion and will, therefore, not be described herein.

In one embodiment, the LEDs 500 may be disposed on a substrate 502, such as, for example, a printed circuit board (PCB). In one embodiment, the LEDs 500 may be disposed on a bottom surface of the substrate 502 and arranged to emit light in a downward-facing direction, when installed. The LEDs 500 and/or the substrate 502 may be disposed within the housing 300. In one embodiment, the housing 300 may be considered to at least partially surround the LEDs 500. In a further embodiment, a light-emitting surface 504, such as a lens surface, together with the housing 300 may surround and house the LEDs 500 therein.

In one embodiment, the housing 300 may be a plastic or other polymer-based material. In another embodiment, the housing 300 may be a transparent material, such as glass. In yet another embodiment, the housing 300 may be a metallic or semi-metallic material. In yet another embodiment, the housing 300 is of a non-heat conductive material. The housing 300 may be externally visible and therefore provided in aesthetically appealing forms. In another embodiment, an external fixture may be disposed external to the housing 300; yet, the housing 300 should still be outward of the LEDs 500. In the depicted embodiment, the housing 300 is formed as a circumferential housing 300. In other embodiments, the housing 300 may be formed as other shapes and configurations, such as, for example, oval or rectangular-shaped.

Figure 5:
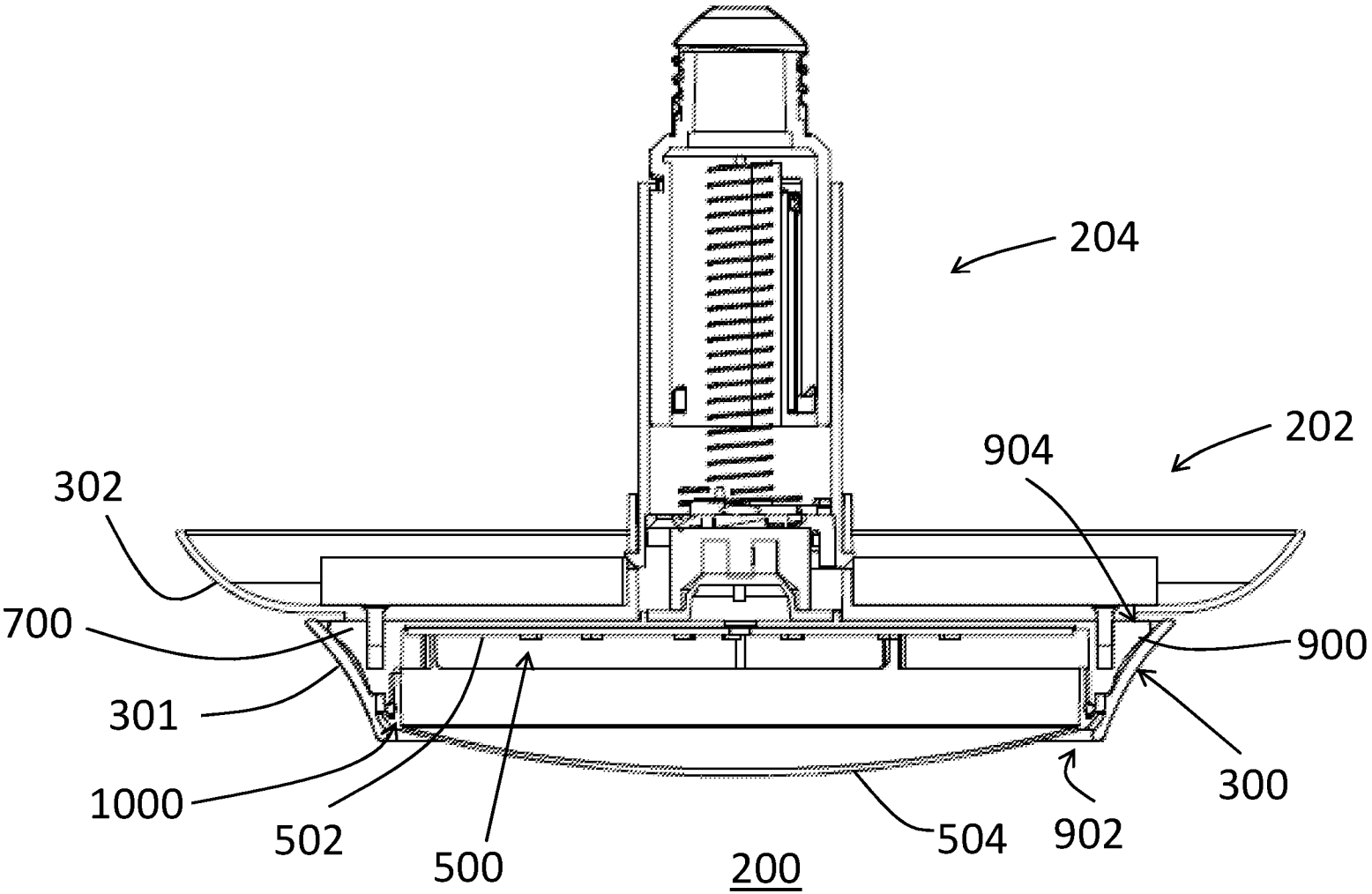
FIG. 5 is a side elevational, cross-sectional view of the LED lighting assembly of FIG. 2 in accordance with the present invention.

In one embodiment, the LED lighting assembly 200 further includes a heat sink. The heat sink may be formed as a plurality of heat dissipating fins 700. The plurality of heat dissipating fins 700 may be considered a plurality of closely spaced, extended surfaces used to improve heat transfer from the interior air heated by the LEDs 500 to the cooler outside atmosphere. The plurality of heat dissipating fins 700 is preferably made of a highly heat conductive material, such as a conductive metallic material or other suitable material, such as a conductive polymer material. The heat dissipating fins 700 may be arranged around the LEDs 500 to draw heated air away from the LEDs 500 in all directions. In one embodiment, the heat dissipating fins 700 may be vertically-oriented fins. In other embodiments, the heat dissipating fins 700 may be oriented in other directions. In one embodiment, the heat dissipating fins 700 are disposed radially outward of the LEDs 500. In another embodiment, the plurality of heat dissipating fins 700 are each equidistant from one another and arranged to extend, preferably substantially closely together, and continuously around the LEDs 500 and the substrate 502 to increase the surface area of the heat sink and thereby its heat dissipating effectiveness. The heat dissipating fins 700 may be considered to extend around a center area of the LED lamp 202, the center area being the area in which the LEDs 500 are disposed and in which heat from the LEDs 500 is generated. In one embodiment, the heat dissipating fins 700 are considered to be disposed between the housing 300 and the LEDs 500, as shown in FIG. 5.

Advantageously, the arrangement of the housing 300 and the plurality of heat dissipating fins 700 together form a plurality of air flow channels 800*a-n*, where "a" may be any number and "n" may be any number greater than "a." Similar to the housing 300 and the heat dissipating fins 700, the plurality of air flow channels 800 may extend circumferentially around the LEDs 500 and the substrate 502. In another embodiment, the plurality of air flow channels 800 may be disposed radially outward of the LEDs 500. Each of the plurality of air flow channels 800 are preferably substantially adjacent to one another, separated only by a shared heat dissipating fin 700. In another embodiment, each of the plurality of air flow channels 800 are equidistant from one another and disposed continuously about a center area occupied by the LEDs 500 and/or the substrate 502.

Referring now primarily to FIGS. 5-6 and 9-10, various configurations of the housing 300 and the plurality of heat dissipating fins 700, forming the plurality of air flow channels 800 to self-cool the LED lighting assembly 200, without a fan, are described. Stated another way, the LED lighting assembly 200 may include a self-cooling engine that has a plurality of air flow channels 800 defined by at least a portion of the housing 300 and the plurality of heat dissipating fins 700.

Figures 9, 10:
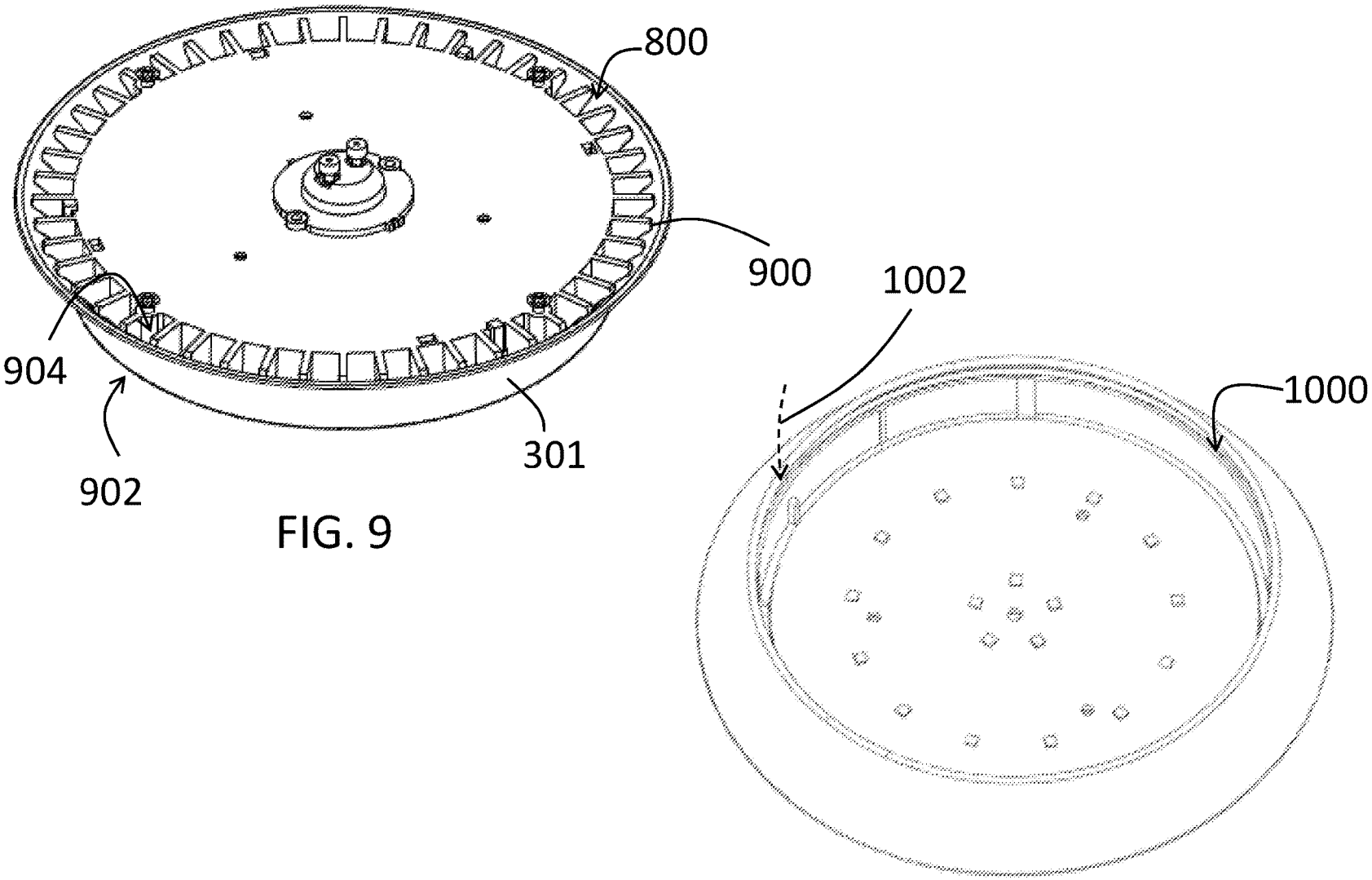
FIG. 9 is a partial, downward-looking perspective view of the LED lamp of FIG. 2, shown uncoupled to the shaft, in accordance with the present invention.
FIG. 10 is a partial, bottom view of the LED lamp of FIG. 2, shown with the light-emitting surface removed so as to reveal the LEDs disposed on a substrate within the LED lamp, in accordance with the present invention.

In one embodiment, as can be seen in FIG. 9, the sidewall portion 301 of the housing 300 may be formed as a circumferential skirt and an inner surface of the sidewall portion 301 may be coupled to a radially outermost edge 900 of each of the plurality of heat dissipating fins 700 so as to define each of the plurality of air flow channels 800. In another embodiment, the sidewall portion 301 may be provided as other shapes, such as a rectangular skirt, for example, in an instance where the LED lamp 202 is generally rectangular shaped, rather than circular. In one embodiment, the inner surface of the sidewall portion 301 may physically touch the radially outermost edge 900 of the heat dissipating fins 700. In other embodiments, the inner surface of the sidewall portion 301 may be disposed substantially adjacent to the outermost edge 900 of the heat dissipating fins 700; yet, not actually touch. In such embodiments, the distance between the outermost edge 900 and the inner surface of the sidewall portion 301 may be considered nominal.

In a preferred embodiment, the sidewall portion 301 of the housing 300 is disposed to visually conceal the heat dissipating fins 700 from the outside environment, as shown in FIG. 2-3. In yet another embodiment, the trim portion 302 may also visually conceal the heat dissipating fins 700 from the outside environment.

As the housing 300 and the heat sink 700 substantially define the air flow channels 800 and the overall self-cooling engine, each of the air flow channels 800 can be considered to have an air flow intake port 902 and a corresponding air flow exhaust port 904. As can be seen in FIG. 5, the air flow intake port 902 is disposed below the air flow exhaust port 904 and the LEDs 500. Advantageously, this arrangement provides a self-cooling engine that is configured to transfer heat generating by the plurality of LEDs 500 to the plurality of heat dissipating fins 700 so as to drive a continuous flow of cooler air into the air flow intake ports 902 and heated air out of the corresponding air flow exhaust ports 904, without a fan, as indicated by the arrows 1500 and 1502, in FIG. 15. Stated another way, heat generated by the LEDs 500 is absorbed by the heat conductive heat sink 700, which, by convection, rises to exit via the air flow exhaust ports 904 and draws in the cooler air from the atmosphere into the air flow intake ports 902 in a substantially continuous manner. In other words, the heat generated by the LEDs 500, due to the arrangement of the housing 300 and the heat sink 700, drives the continuous flow of air through the air flow channels 800, thereby cooling the LEDS 500 without a fan.

In one embodiment, each air flow intake port 902 may be at least partially defined by a lower portion of the housing 300 and a lower portion of at least one of the plurality of heat dissipating fins 700. In a further embodiment, each air flow intake port 902 is defined by a lower portion of the sidewall portion 301 and a lower portion of at least two adjacent heat dissipating fins 700. In one embodiment, each air flow exhaust port 904 is at least partially defined by an upper portion of the housing 300 and an upper portion of at least one of the plurality of heat dissipating fins 700. In a further embodiment, each air flow exhaust port 904 is defined an upper portion of the sidewall portion 301 and an upper portion of at least two adjacent heat dissipating fins 700. In yet another embodiment, each air flow exhaust port 904 and/or air flow intake port 902 may be defined by other portions of the housing 300 and the heat sink 700; yet, should still be arranged such that the air flow intake port 902 is disposed below the air flow exhaust port 904 and below the LEDs 500.

Figure 16:
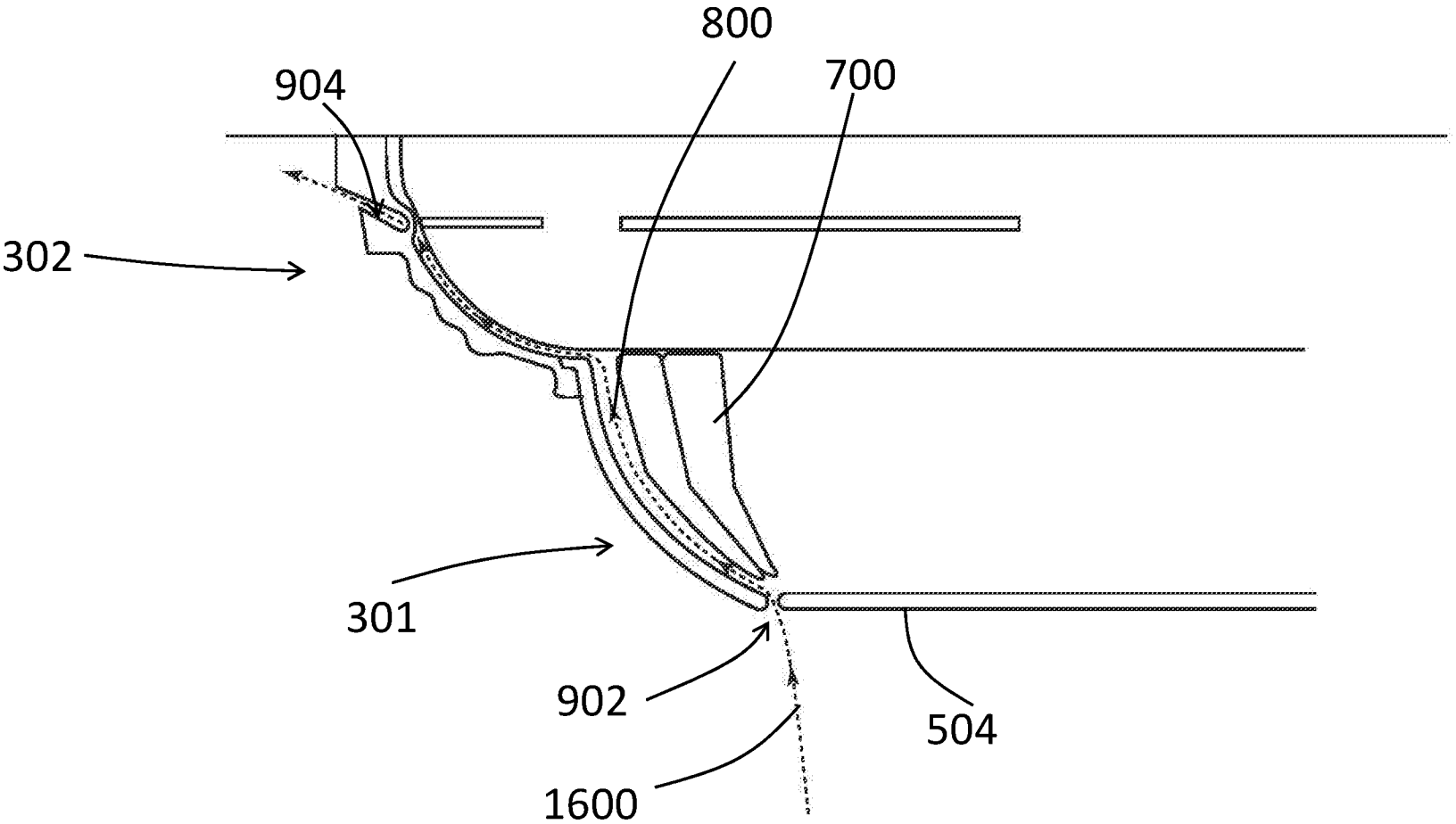
FIG. 16 is a partial, cross-sectional view of another exemplary embodiment of an LED lighting assembly, mounted to a ceiling and having an air flow exhaust port defined by a trim, in accordance with the present invention.

As can be seen in FIG. 5, in one embodiment, the air flow exhaust ports 904 are disposed between the sidewall portion 301 and the trim portion 302. Referring briefly to FIG. 16, in an alternative embodiment, the air flow exhaust ports 904 are defined by the trim portion 302, rather than the sidewall portion 301 of the housing 300. In the exemplary embodiment depicted in FIG. 16, the air flow intake port 902 may be formed as a gap between the lens 504 and the sidewall portion 301. In yet a further embodiment, the air flow intake port 902 and/or the air flow exhaust port 904 may be formed as a circumferential aperture disposed continuously, circumferentially about the periphery of the housing 300 so as to maximize the heat dissipating, self-cooling effect. In one embodiment, an external surface of the trim portion 302 may include a decorative feature. In another embodiment, the sidewall portion 301 may also be visually aesthetically pleasing, such as being formed as a glass trim, for example. As can be seen by the arrow 1600 in FIG. 16, the continuous flow of air travels in a generally upward direction from the cooler outside atmosphere (substantially below the exhaust port 904), into the intake port 902, through the air flow channel 800 (defined by the heat dissipating fins 700 and the sidewall portion 301), through a portion of the air flow channel 800 defined by the trim portion 302, and out of the air flow exhaust port 904 on the trim portion 302, into the cooler atmosphere substantially above the air flow intake port 902. Accordingly, embodiments of the present invention represent a significant improvement over prior art LED devices, as depicted in FIG. 1, by driving the hot air away from the recessed ceiling can so as not to continuously re-expose the hot air to the LED device, which would decrease the life span of the LEDs housed therein. As with the embodiment depicted in FIGS. 2-15, the heat sink 700 and the air flow channels 800 advantageously force and guide the hot air into the atmosphere.

Referring again primarily to the embodiment depicted in FIGS. 2-15, and more particularly to FIGS. 4-5, a shape of the outer periphery 400 of the housing 300 and/or a shape of the outermost edge 900 of the heat dissipating fins 700 may assist with guiding the hot air away from the recessed ceiling can. In one embodiment, the outer periphery 400 of the housing 300 and each of the plurality of heat dissipating fins 700 has a concave outer surface ("concave" being defined from the viewpoint of the outside environment). According, the concave shape of the outer surface of the housing 300, and in particular the sidewall portion 301, as well as the concave shape of the heat dissipating fins 700, and in particular the outermost edge 900 of the heat dissipating fins 700, directs or guides the continuous flow of air away from the standard-sized light bulb ceiling recess 1300 (see FIG. 15).

Referring now briefly primarily to FIGS. 3-5, in one embodiment, the LED lighting assembly 200 may include a main exhaust port 402. As indicated by the arrows 404, the continuous flow of air may enter the air flow intake ports 902 and exit out of the main exhaust port 402. The main exhaust port 402 may be considered to define a main exhaust port opening 402 that extends circumferentially, continuously about the housing 300 to efficiently and effectively release the hot air into the atmosphere. In one embodiment, the main exhaust port 402 may be disposed slightly above the plurality of air flow exhaust ports 904 associated with the plurality of air flow channels 800. Accordingly, the main exhaust port 402 may further guide the hot air exiting the plurality of air flow exhaust ports 904 into the atmosphere. As can be seen particularly well in FIG. 9, as compared to FIG. 4, while the openings for the air flow exhaust ports 904 are oriented in an upwardly-facing direction (toward the ceiling), in one embodiment, the main exhaust port opening 402 may be oriented laterally so as to direct the hot air into the atmosphere in a substantially horizontal direction (as indicated by the arrows 404). This feature advantageously guides the hot air even more so away from the ceiling and the recessed ceiling can. As used herein, the "substantially horizontal direction" is defined as directions parallel to a downward-facing surface 1304 of the ceiling 1302 (+ or −45 degrees).

In some embodiments, the main exhaust port 402 may be defined by the trim portion 302 (e.g., FIG. 16) and/or the sidewall portion 301 of the housing 300. In a further embodiment, the main exhaust port 402 may be formed as a gap between a lower end of the trim portion 302 and an upper end of the sidewall portion 301. In yet another embodiment, the main exhaust port 402 may be formed as a circumferential gap between the trim portion 302 and the sidewall portion 301, as depicted in FIG. 4.

Referring briefly to FIG. 10, depicting a bottom view of the LED lamp 202, with the lens 504 removed (not shown), in one embodiment, the LED lighting assembly 200 may include a main intake port 1000. As indicated by the arrow 1002, the continuous flow of air may enter the main intake port 1000 from the cooler air in the outside environment and exit out of the main exhaust port 402 (see FIG. 4). The main intake port 1000 may be formed as a main intake port opening 1000 that extends circumferentially, continuously about a bottom portion of the housing 300 to efficiently and effectively receive the cooler air in the atmosphere into the air flow channels 800 (see FIGS. 7-8). In one embodiment, the main intake port 1000 may be disposed slightly below the plurality of air flow intake ports 902. Accordingly, the main intake port 1000 may further guide the cool air into the air flow channels 800. In one embodiment, the main intake port 1000 may be considered a circumferential gap extending along a bottom portion of the housing 300 and disposed between a bottom portion of the sidewall portion 301 and the lens 504, as can be seen in FIG. 5.

Referring again primarily to FIGS. 3-5, with brief reference also to FIGS. 13 and 15, in one embodiment, the trim portion 302 may extend upwardly and radially away from the sidewall portion 301. In another embodiment, the trim portion 302 may include a ceiling-contacting surface 406 at an absolute upper end of the trim portion 302. The ceiling-contacting surface 406 may be shaped to engage the downward-facing surface 1304 of the ceiling 1302. More particularly, the ceiling-contacting surface 406 may be shaped to engage the ceiling surface 1304 surrounding the standard-sized light bulb ceiling recess 1300 so that the LED lamp 202 may be flush with the ceiling surface 1304, as shown in FIG. 15. The trim portion 302 may be provided in various shapes, sized and configurations. In one embodiment, the trim portion 302 may be provided with a convex outer surface that further guides the hot air in the substantially horizontal direction. In yet another embodiment, the trim portion 302 is selectively removable from the housing 300 so as to allow users to selectively change the aesthetic look and feel of the LED lighting assembly 200. In yet other embodiments, the LED lighting assembly 200 may not include the trim portion 302.

Having described various features and embodiments of the self-cooling LED lamp 202, the shaft 204 will now be described, with reference primarily to FIGS. 2-6 and 11-15.

The shaft 204 is preferably a length adjustable shaft 204 so that the vertical position of the LED lamp 202 can be adjustable when installed on the ceiling. Stated another way, the length adjustable shaft 204 may be selectively moveable so as to selectively move the plurality of LEDs 500, the housing 300, the lens 504, and the plurality of heat dissipating fins 700 together toward and away from the ceiling when the electrical contact portion 206 is coupled to a standard light-bulb outlet 1306 disposed within the standard-sized light bulb ceiling recess 1300.

In one embodiment, the shaft 204 may have a first end 208 and a second end 210. The first end 208 may be disposed opposite the second end 210. The electrical contact portion 206 may be disposed on the first end 208 and the second end 210 may be coupled to the self-cooling LED lamp 202. In a further embodiment, the second end 210 may be removeably couplable to the LED lamp 202. In yet a further embodiment, the second end 210 may be removeably couplable to the LED lamp 202 by a one-step coupling, e.g., twisting or rotational movement. For example, the LED lamp 202 may include a receptacle for the second end 210 with grooves, for example, and mating protrusions on the second end 210 of the shaft may permit selective mating coupling of the second end 210 with the LED lamp 202.

The LED lamp 202 should also be electrically couplable to the electrical contact portion 206 on the shaft 204. Electrical wiring and connectors of any known type (e.g., GU10, GUI24, Bi pins, plugs, etc.) may be disposed within the shaft 204 and/or the LED lamp 202. Further, the shaft 204 and/or the LED lamp 202 may be coupled together such that when the electrical contact portion 206 is electrically and mechanically coupled to the standard light-bulb outlet 1306 disposed within the standard-sized light bulb ceiling recess 1300 (see FIG. 15), the plurality of LEDs 500 are also electrically coupled to receive power for emitting light. In one embodiment, the shaft 204 is configured to be selectively couplable to the plurality of LEDs 500 via a one-step mechanical and electrical coupling. In such embodiment, the shaft 204 and LED lamp 202 may be configured with mechanical and electrical connectors that may facilitate a convenient one-step mechanical, as well as, electrical coupling of the shaft 204 with the LED lamp 202. As just one example, the one-step mechanical and electrical coupling may be performed by a twisting motion in one of a clockwise and a counter-clockwise direction. In other embodiments, the shaft 204 and the LED lamp 202 may be fixedly mechanically and electrically coupled to one another, generally requiring the user to purchase another LED lighting assembly 200 when the LEDs 500 no longer emit light.

Figure 6:
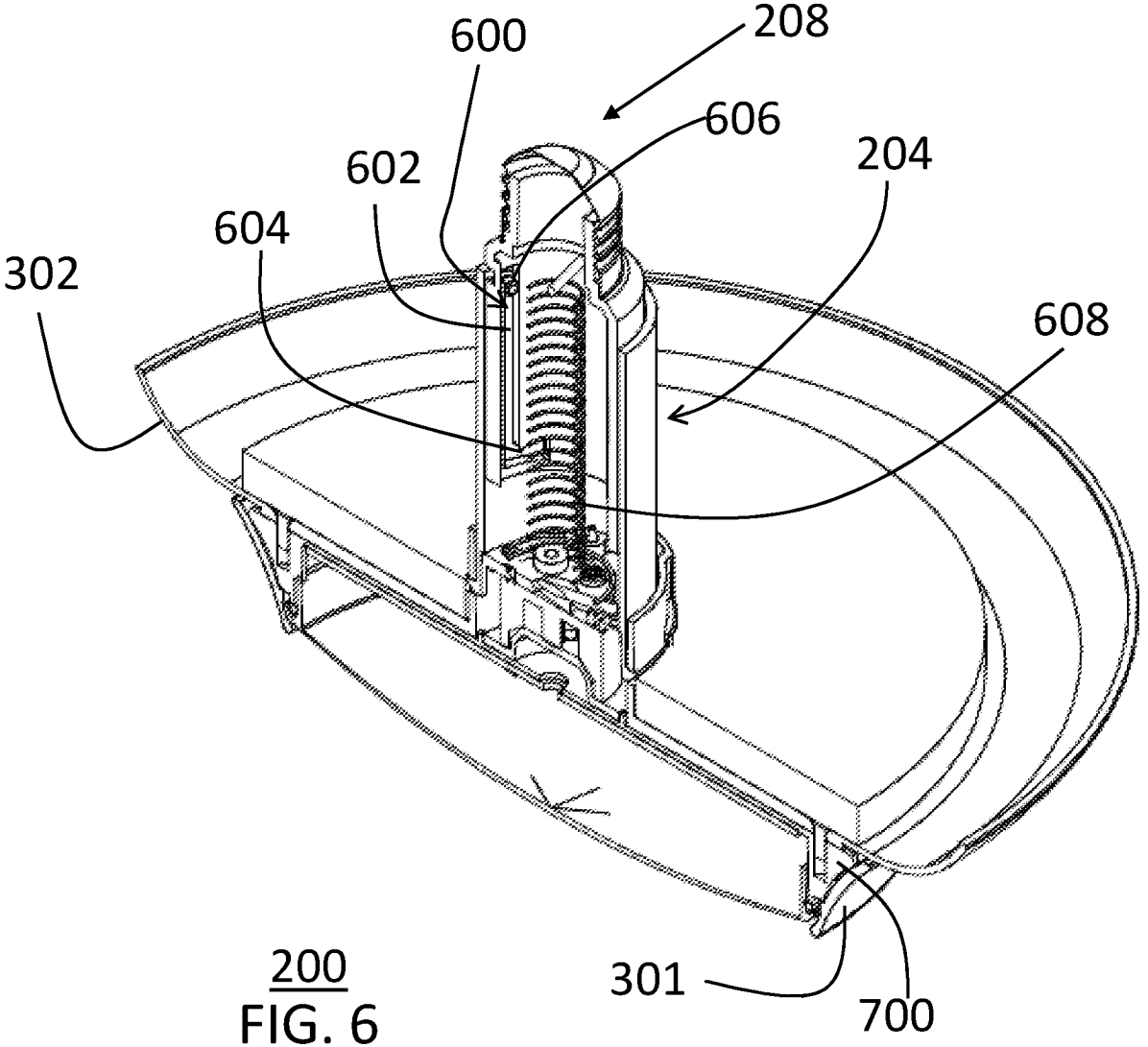
FIG. 6 is a fragmentary, downward-looking perspective view of the LED lighting assembly of FIG. 2 illustrating a length-adjustment and resistance mechanism associated with the shaft in accordance with an exemplary embodiment of the present invention.
Figure 12:
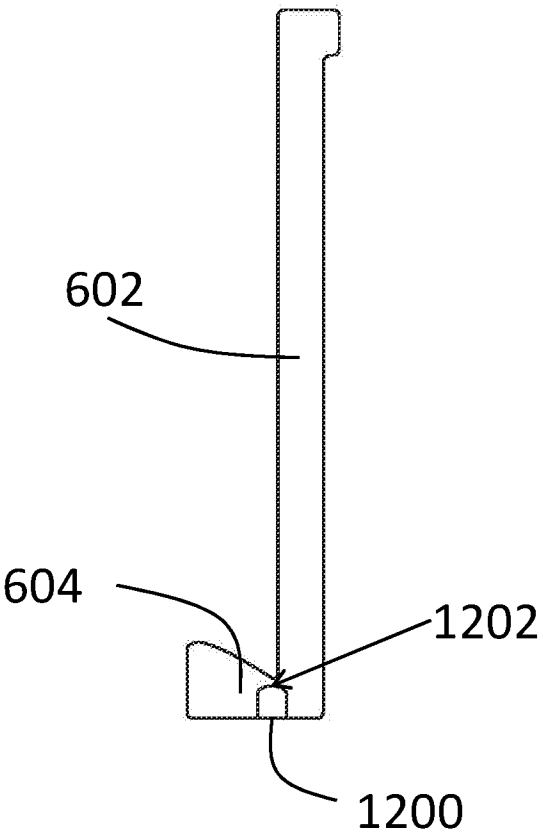
FIG. 12 is a schematic view of yet another alternative embodiment of a slot shape on the shaft with a break-away tab in accordance with the present invention.

Referring primarily now to FIG. 6, with brief reference to FIG. 12, in one embodiment, the shaft 204 includes a slot area 600 that defines at least one slot. In a further embodiment, the slot area 600 defines at least two slot portions 602, 604. In yet a further embodiment, there may be more than two slot portions 602, 604, or less than two slot portion 602, 604. As used herein, the term "slot" is defined as a narrow opening, aperture, and/or groove. In one embodiment, the slot portions 602, 604 are continuous with one another. Stated another way, the slot portions 602, 604 should follow a continuous passageway from one slot portion 602 to an adjacent slot portion 604. In another embodiment, the slot portions 602, 604 may be temporarily discontinuous, such as, for example, having a break-away tab 1200 (see FIG. 12.). The break-away tab 1200 may be disposed between the slot portions 602, 604 and provide a temporary barrier/resistance between the slot portions 602, 604. In use, the user may be required to provide a sufficient rotational force to break the tab 1200, thereby permitting movement of a protrusion between the slot portions 602, 604, as will be described herein in more detail.

Figure 8:
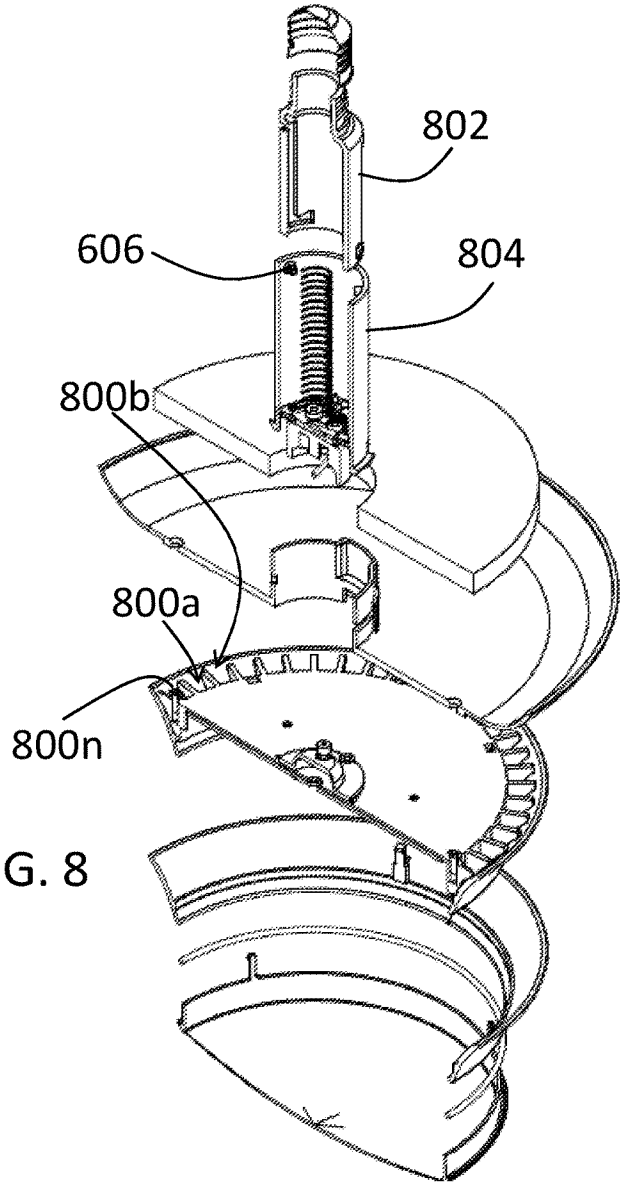
FIG. 8 is a fragmentary, exploded, downward-looking perspective view of the LED lighting assembly of FIG. 2 in accordance with the present invention.
Figure 7:
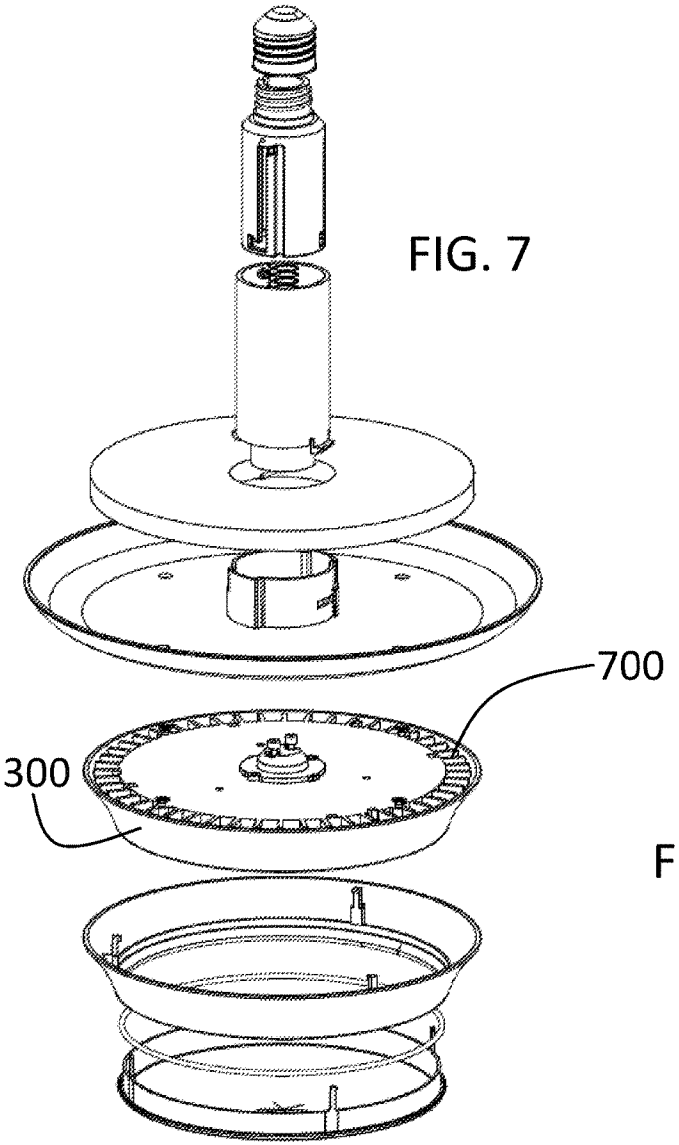
FIG. 7 is an exploded, downward-looking perspective view of the LED lighting assembly of FIG. 2 in accordance with the present invention.

Referring again primarily to FIG. 6, with brief reference to FIG. 8, there may be a shaft length adjustment member 606 that is selectively moveable within the slot portions 602, 604. The shaft length adjustment member 606 may be formed as a protrusion, sized and shaped for movement within the slot portions 602, 604. In one embodiment, the shaft length adjustment member 606 may be formed as a protrusion extending radially inward of the shaft sidewall, as can be seen in FIG. 8. In the exemplary embodiment depicted in FIG. 8, the shaft 204 includes a first telescoping member 802 and a second telescoping member 804. The first telescoping 802 member may define the slot portions 602, 604. The second telescoping member 804 may include the shaft length adjustment member 606. In such embodiment, when the telescoping members 802, 804 are assembled (one disposed within the other), the shaft length adjustment member 606 may be disposed within a portion of the slot portions 602, 604 and may be moveable within the slot portions 602, 604 to selectively adjust the length of the shaft 204 based on which of the slot portions 602, 604 the shaft length adjustment member 606 is disposed within. As an example, the user may fully extend the shaft 204 and move the shaft length adjustment member 606 within the slot portion 604, which may lock the shaft 204 in the fully extended configuration (see FIG. 13). The user may subsequently rotate the shaft 204 and cause the shaft length adjustment member 606 to move to the slot portion 602, which due to its generally vertical orientation and a biasing mechanism (e.g., a spring biasing the shaft 204 toward its first end 208), may automatically cause the shaft 204 to collapse toward the ceiling 1302. There may be other shapes, sizes, and configurations of the slot portions 602, 604 and the shaft length adjustment member 606, but they should still allow the length of the shaft 204 to be selectively adjusted based on which of the slot portions 602, 604 the shaft length adjustment member 606 is disposed within.

Importantly for the shaft 204, there should be a resistance mechanism associated with the shaft 204 so that rotation of the shaft 204 does not cause the shaft 204 to collapse sooner than desired. In other words, the shaft 204 should not collapse until the electrical contact portion 206 and the LED lamp 202 is fully mechanically and electrically coupled to the standard light-bulb outlet 1306 within the recessed ceiling can 1300. Without a resistance mechanism, some embodiments of the shaft 204 would collapse immediately upon a rotational movement, even though the electrical contact portion 206 has not been fully coupled to the light-bulb outlet 1306. Accordingly, in one embodiment, a resistance member 608 is associated with the shaft 204. The resistance member 608 may provide a resistance force operable to resist a movement of the shaft length adjustment member 606 within the slot portions 602, 604. More specifically, the shaft 204 may be considered to transmit a rotational force from a user to couple the electrical contact portion 206 to the standard light-bulb outlet 1306. Further, the resistance member 608 is preferably operable to 1) resist a movement of the shaft length adjustment member 606 within the slot portions 602, 604 as the shaft 204 transmits the rotational force from the user to mechanically couple the electrical contact portion 206 to the standard light-bulb outlet 1306; and 2) permit a movement of the shaft length adjustment member 606 within the slot portions 602, 604 as a result of the shaft continuing to transmit the rotational force from the user after the electrical contact portion 206 is substantially mechanically coupled to the standard light-bulb outlet 1306. In other words, the resistance member 608 should be configured to provide sufficient resistance such that the user can rotate the shaft 204 to screw the light into the outlet 1306, but then once the light is screwed into the outlet 1306, the resistance member 608 should allow a continuing screwing/rotational movement of the shaft 204 to overcome the resistance member 608, moving the shaft length adjustment member 606 to the generally vertically-oriented slot portion 602, thereby causing the shaft 204 and the LED lamp 202 to automatically translate toward the first end 208 of the shaft 204. Advantageously, the resistance member 608 provides a functionally improved installation apparatus and method that is configured to initially resist a movement of the shaft length adjustment member 606 within the slot portions 602, 604 (when the user is screwing in the light) and subsequently to permit such movement of the shaft length adjustment member 606 within the slot portions 602, 604 (after the light is fully coupled to the outlet 1306).

In one embodiment, at least a portion of the resistance member 608 is disposed within the shaft 204. In another embodiment, the resistance member 608 is disposed on the shaft 204. In some embodiments, there may be more than one resistance member 608, together being operably configured to provide a sufficient amount of resistance force when desired and yet allow the resistance force to be overcome by the user when desired (as discussed herein above).

In one embodiment, the resistance member 608 includes a spring disposed within the shaft 204, the spring providing a resistance force operable to resist a movement of the shaft length adjustment member 606. In such embodiment, when the user screws the light into the socket, the light can be screwed all the way in and a continued screwing motion (after the light is screwed all the way in) causes the spring to be extended because the shaft length adjustment member 606 in the slot portions 602, 604 extends the shaft 204 slightly against the tension of the spring. When the shaft length adjustment member 606 is moved from the slot portion 604, which holds the shaft 204 in the extended configuration, to the slot portion 602, the biasing force of the spring automatically causes the shaft to collapse, moving the LED lamp 202 towards the electrical contact portion 206.

Figure 11:
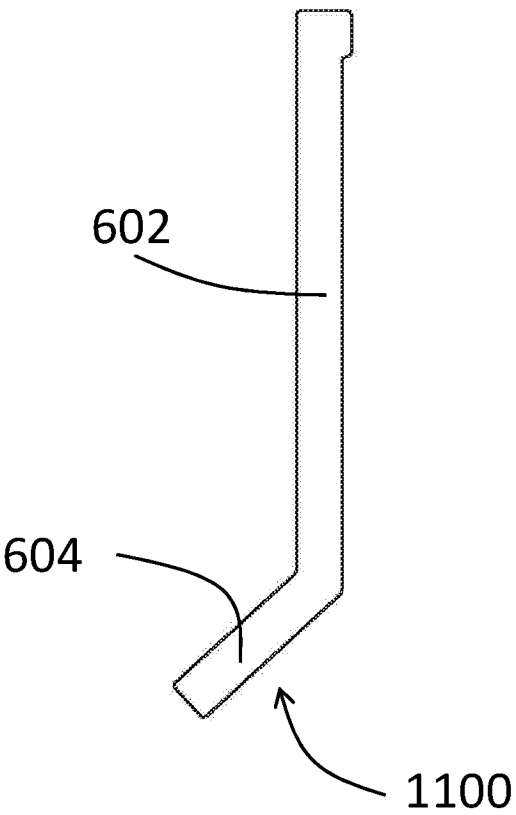
FIG. 11 is a schematic view of an alternative embodiment of a slot shape on the shaft with an inclined slot portion as an additional resistance feature in accordance with the present invention.

In other embodiments, there may other forms and configurations to provide a resistance force. These may be provided in replacement of or in addition to the spring. Referring now primarily to FIGS. 11 and 12, which is a schematic view of alternative embodiments of the slot portions 602, 604, in one embodiment, the resistance member 608 may include a speed bump or constriction 1202 within a transitional area between the slot portions 602 and 604. The constriction 1202 may be formed as a narrow, flexible opening between adjacent slot portions 602, 604 that provides resistance against a movement of the shaft length adjustment member 606 from one slot portion 604 into the adjacent slot portion 602. The area of the shaft 204 defining the constriction 1202 should be flexible so as to eventually allow the shaft length adjustment member 606 to squeeze past the constriction 1202 into the adjacent slot portion 602.

It should be understood that although the slot portion 602 is depicted as absolutely vertically-oriented (i.e., parallel to an elongation direction of the shaft), other embodiments of the slot portion 602 may be disposed at other angles. For example, in other embodiments, the slot portion 602 may be at a slight incline.

In yet another embodiment, the resistance member 608 may be formed as, or include, a spring-ball detent that requires compression for the shaft length adjustment member 606 to move from the slot portion 604 into the slot portion 602. In yet another embodiment, the resistance member 608 may include an incline 1100 of the slot portion 604 that resists movement of the shaft length adjustment member 606 from the slot portion 604 to the adjacent slot portion 602. In yet another embodiment, the resistance member 608 may include the break-away tab 1200. The tab 1200 may be a one-time use tab that breaks off the first time the user is able to move the shaft length adjustment member 606 from the slot portion 604 to the slot portion 602. In one embodiment, the tab 1200 may be made of a plastic or other polymer material. An edge of the tab 1200 that meets an edge of the slot portion 604 may be formed relatively thin such that movement of the shaft length adjustment member 606 over the edge breaks the edge of the tab 1200 off. Advantageously, the resistance member 608 is able to prevent the shaft 204 from collapsing too soon.

Referring now briefly to FIGS. 13-15, an exemplary method of installing the LED assembly 200 within the recessed ceiling can 1300 is described. The user may move the shaft length adjustment member 606 into the slot portion 604, locking the shaft 204 in an extended configuration, as shown in FIG. 13. The user may next couple the electrical contact portion 206 to the outlet 1306 by rotating/screwing the shaft 204/electrical contact portion 206, in a clockwise direction 1400, into the outlet 1306, as shown in FIG. 14. After the electrical contact portion 206 is screwed into the outlet 1306, the user may continue rotating the shaft 204, overcoming the resistance member 608, thereby permitting the shaft length adjustment member 606 to move to the slot portion 602. Responsive to the shaft length adjustment member 606 moving to the slot portion 602, the spring's bias and the shape of the slot portion 602 allows the shaft 204 to automatically collapse, moving the LED lamp 202 towards the ceiling, as shown in FIG. 15. A portion of the outer periphery 400 of the housing 300 engages the ceiling, allowing the LED lamp 202 to be mounted flush with the ceiling.

Figure 17:
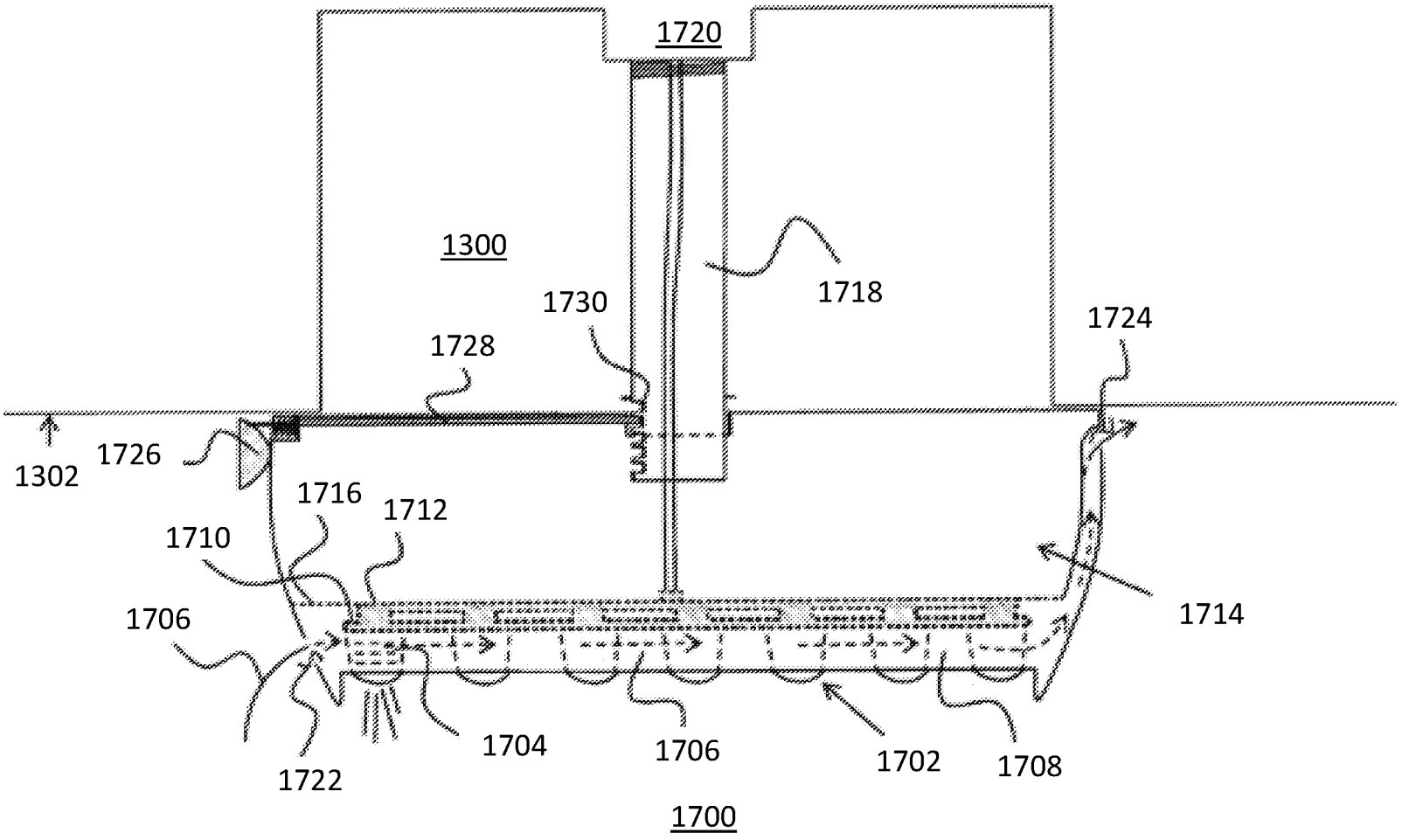
FIG. 17 is a side elevational, cross-sectional, view of a self-cooled lighting assembly in operation that is coupled to a standard-sized light bulb outlet, with the assembly being adjustable in accordance with an embodiment of the present invention.

FIG. 17 illustrates another embodiment of the LED lighting assembly 1700. The assembly 1700 has an LED assembly 1702 with multiple light sources 1704 within that have a portion subjected to airflow (represented with arrows 1706) within the airflow channel 1708. In one embodiment, the airflow chamber 1714 may form one single channel 1708 that subjects all of the light sources 1704 to the airflow. In other embodiments, the airflow chamber 1714 may section into multiple chambers 1714 that define a plurality of individual airflow channels 1708 that subject the airflow to one or more LED light sources 1704. FIG. 17 also shows the LED assembly 1702 with a power supply 1712 and a circuit board 1710 coupled thereto and subjected to the airflow. In other embodiments, the power supply 1712 and/or circuit board 1710 may be located physically outside the airflow channel 1708, but may have one or more heat sinks coupled thereto, such that they could be said to be thermally coupled to the airflow channel 1708. The one or more light sources 1702 may be coupled to a portion 1716 of the airflow chamber 1714. The chamber 1714 has a first opening 1722 at the lower side of the chamber 1714 and the second opening 1724 is located at the upper side of the chamber 1714. In other embodiments, there may be more than one opening or the openings may be in different locations on the chamber 1714. Further, the second opening 1724 is shown expelling the air on the side of the chamber, but in other embodiments, the second opening 1724 may expel the hot air into the recessed portion 1300 of the ceiling 1302 where it is then transported upwardly through the building.

In contrast to embodiments where the airflow chamber is a single piece of material and separate and independent from an LED assembly, the airflow chamber 1714 in FIG. 17 is integrated with the LED assembly 1702. In one example of the present invention, the chamber 1714 is adjustable along a shaft 1718 either before, or after, the assembly 1700 is screwed into the light-bulb outlet 1720. The chamber 1714 is translated upward or downward at will by a user. This can be accomplished, for example, by ball detents, friction, by pressing and depressing a button 1726 the releases a shaft 1728 into a plurality of slots 1730, or any other mechanical mode for allowing two objects to selectively translate relative to one another. This feature allows the user to selectively adjust the chamber 1714 to an appropriate height sufficient for it to be flush against the ceiling 202.

Figure 18:
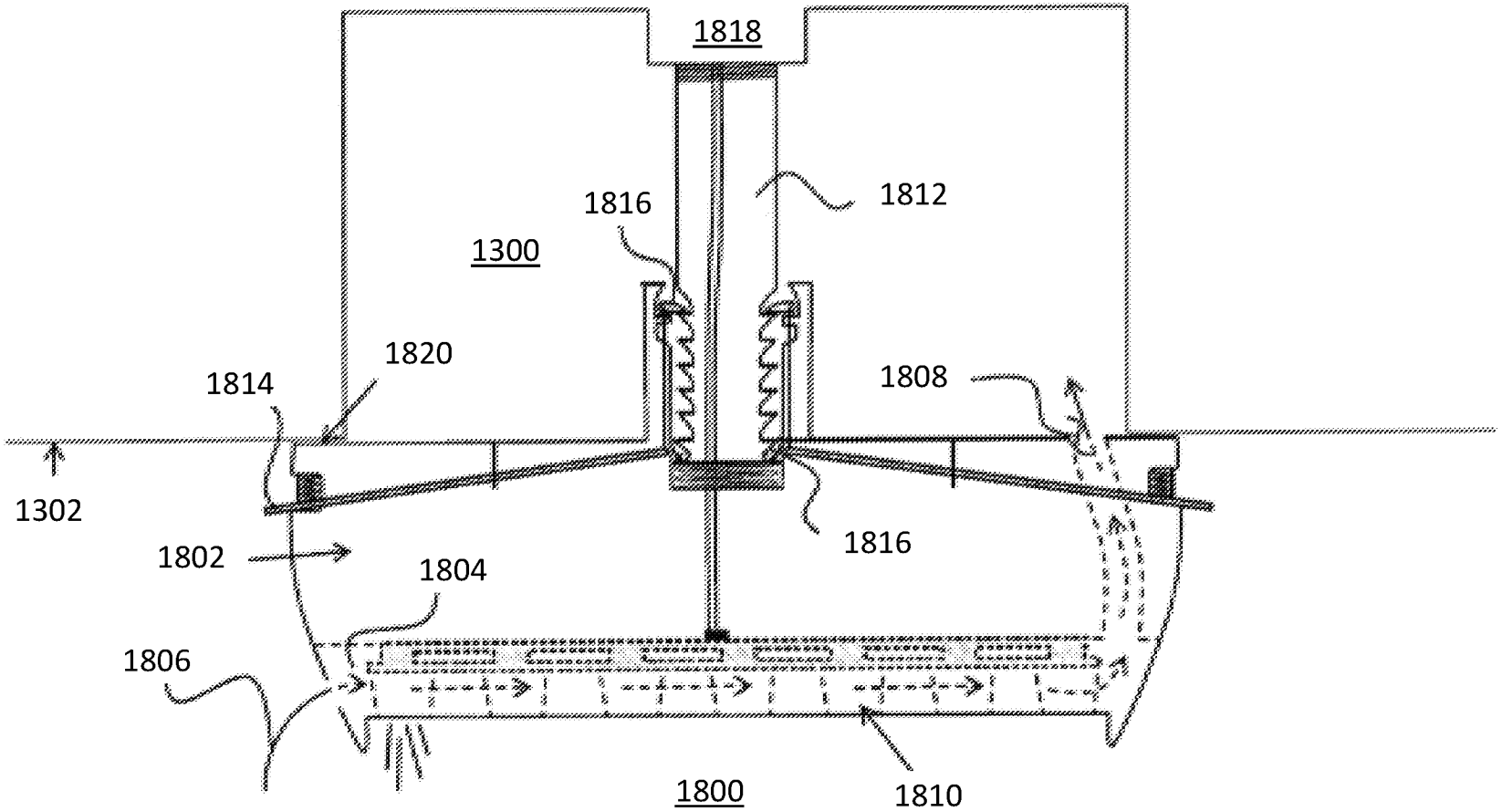
FIG. 18 is a side elevational, cross-sectional, view of a self-cooled lighting assembly in operation that is coupled to a standard-sized light bulb outlet, with the assembly being adjustable in accordance with an embodiment of the present invention.

Referring now to FIG. 18, another example of the present invention is shown. The chamber 1802 defines an airflow channel 1804 that facilitates and directs the transfer of airflow (represented by arrows 1806) to the second opening 1808. The second opening 1808 expels the hot air generated from the components of the LED assembly 1810 into the recessed 1300 portion of the ceiling 1302 where it is transferred into the ceiling through the electrical outlet 1818 or one or more portions 1820 of the upper surface of the assembly 1800. Similar to FIG. 17, the assembly 1800 is adjustable vertically along the shaft 1812. In one embodiment, when the assembly 1800 is to be adjusted, the user presses the lever 1814. The assembly 1800 is coupled to the shaft 1812 with rotatable hooks 1816 that prevents chamber 1802 from traveling pass the end of the shaft 1812. The shaft 1812 may also have a void located therein for electrical wiring. In other embodiments, the assembly 1800 may be adjustable using notches, threading, or other similar means to allow the assembly 1800 to be adjusted as discussed.

A novel and efficient ceiling mounted LED lighting assembly has been disclosed with a cooling feature that continuously cools the LEDs without a fan and directs hot air away from a recessed ceiling can. Embodiments of the invention provide a heat sink formed as a skirt disposed around a periphery of the LEDs and that is disposed between the LEDs and an outer periphery of a housing of the LED lighting assembly. In addition, embodiments of the invention provide for the heat sink fins and the housing to define a plurality of air flow channels disposed around the LEDs such that heat generated by the LEDs is transferred to the heat sink fins, driving a continuous flow of air through the air flow channels. In such embodiments, lower portions of the heat sink fins and housing may be considered air flow intake ports and upper portions of the heat sink fins and housing may be considered air flow exhaust ports. Embodiments of the present invention provide for the outer periphery of the housing to have a dimension exceeding a maximum opening dimension of a standard-sized recessed ceiling can, with the air flow channels disposed beneath the ceiling, in an installed configuration, and arranged to direct hot air away from the recessed ceiling can so as not to trap the hot air within the recess. Further embodiments of the present invention provide for a surface of the housing and heat sink fins having a concave shape that guides the hot air away from the LED lighting assembly and the recessed ceiling can. In additional embodiments, the LED lighting assembly includes a trim above a sidewall portion, the trim and the sidewall portion together defining a main exhaust port extending continuously, circumferentially between the trim and the sidewall portion to permit the continuous flow of hot air to escape into the atmosphere in a generally horizontal direction away from the LED lighting assembly and the recessed ceiling can. Yet other embodiments of the present invention, including an adjustable length shaft with a resistance member.

What is claimed is:

1. A mount for an LED lighting assembly for a recessed ceiling can defining a recess in a ceiling, comprising:

a length adjusting shaft having adjustment features formed on the shaft;

an electrical contact portion disposed at a first end of the length adjusting shaft, the electrical contact portion electrically couplable with a light-bulb outlet disposed within the ceiling recess can and electrically coupled to provide power to the LED lighting assembly;

a housing defining a chamber, the housing being adjustable along the length adjusting shaft and includes a releasable engagement for engaging one of the adjustment features on the length adjusting shaft, wherein the housing is configured to cover the recess;

a circuit board disposed in the housing and having a plurality of LEDs configure to emit light through a bottom of the housing; and an external release disposed outside the housing that is coupled to the releasable engagement and configured to release the releasable engagement from the one of the adjustment features, wherein the external release is accessible on an outside of the housing when the housing is in place covering the recess.

2. The mount for an LED lighting assembly in accordance with claim 1, wherein the adjustment features comprise a plurality of slots formed in the shaft, and the releasable engagement comprises a shaft having a first end that engages the one of the slots to hold the housing in place relative to the shaft, and the external release comprises a button coupled to a second end of the shaft.

3. The mount for an LED lighting assembly in accordance with claim 1, wherein the adjustment features comprise a plurality of notches formed in the shaft, and the releasable engagement comprises a shaft having a first end having a hook that is configured to engage the notches to hold the housing of the LED lighting assembly in place relative to the shaft, and the external release comprises a lever coupled to a second end of the shaft that is configured to release the hook from engagement with the notches to allow the housing to be moved downward along the shaft.

4. The mount for an LED lighting assembly in accordance with claim 1, wherein the housing comprises a plurality of air flow exhaust ports formed at an upper side of the housing.

5. The mount for an LED lighting assembly in accordance with claim 1, wherein the housing includes and airflow channel to subject the LEDs to airflow.

6. The mount for an LED lighting assembly in accordance with claim 1, wherein the circuit board is coupled to a heatsink that is disposed inside the housing.

7. The mount for an LED lighting assembly in accordance with claim 1, wherein the housing comprises an opening at a lower side of the housing.

8. A mount for an LED lighting assembly for a ceiling recess can, the mount comprising:

a length adjusting shaft having adjustment features formed on the shaft that are configured to releasably retain the housing on the shaft;

a housing having an outer periphery configured to fit flush against a surface of a ceiling in which the ceiling recess can is mounted and cover the ceiling recess;

a releasable engagement for engaging one of the adjustment features disposed within the housing to hold the housing on the length adjusting shaft; and an external release disposed outside the housing that is coupled to the releasable engagement and configured to release the releasable engagement from the one of the adjustment feature, wherein the external release is accessible on the outside of the housing when the housing is in place covering the recess.

9. The mount for an LED lighting assembly in accordance with claim 8, wherein the adjustment features comprise a plurality of slots formed in the shaft, and the releasable engagement comprises a shaft having a first end that engages the one of the slots to hold the housing in place relative to the shaft, and the external release comprises a button coupled to a second end of the shaft.

10. The mount for an LED lighting assembly in accordance with claim 8, wherein the adjustment features comprise a plurality of notches formed in the shaft, and the releasable engagement comprises a shaft having a first end having a hook that is configured to engage the notches to hold a housing of the LED lighting assembly in place relative to the shaft, and the external release comprises a lever coupled to a second end of the shaft that is configured to release the hook from engagement with the notches to allow the housing to be moved downward along the shaft.

11. The mount for an LED lighting assembly in accordance with claim 8, wherein:

the housing includes at least one air flow exhaust port.

12. The mount for an LED lighting assembly in accordance with claim 8, further comprising:

an electrical contact portion electrically couplable with a light-bulb outlet disposed within the ceiling recess can and electrically coupled to power the LED lighting assembly; and wherein an outer periphery of the housing is shaped to direct a continuous flow of air through the housing.

13. The mount for an LED lighting assembly in accordance with claim 8, wherein:

the housing includes a the plurality of air flow channels.

14. The mount for an LED lighting assembly in accordance with claim 8, further comprising:

a heat sink;

the housing further include an airflow channel thermally coupled to the heat sink.

15. The mount for an LED lighting assembly in accordance with claim 8, wherein:

the housing includes a port opening formed at an upper side of the housing.

16. A mount for an LED lighting assembly for connecting to and covering a recessed ceiling can, the mount comprising:

length adjusting shaft having adjustment features formed on the shaft that are configured to releasably retain the housing on the shaft;

a housing configured to fit over and cover the ceiling recess;

a releasable engagement for engaging one of the adjustment features to hold the housing onto the length adjusting shaft; and an external release disposed outside the housing that is coupled to the releasable engagement and accessible when the housing is covering the ceiling recess, the external release further configured to release the releasable engagement from the one of the adjustment features;

wherein the housing is configured to fit flush against a surface of a ceiling in which the ceiling recess can is mounted and wherein the releasable engagement holds the housing flush against the ceiling.

17. The mount for an LED lighting assembly of claim 16, wherein the adjustment features comprise a plurality of slots formed in the shaft, and the releasable engagement comprises a shaft having a first end that engages the one of the slots to hold the housing in place relative to the shaft, and the external release comprises a button coupled to a second end of the shaft.

18. The mount for an LED lighting assembly of claim 16, wherein the adjustment features comprise a plurality of notches formed in the shaft, and the releasable engagement comprises a shaft having a first end having a hook that is configured to engage the notches to hold the housing in place relative to the shaft, and the external release comprises a lever coupled to a second end of the shaft that is configured to release the hook from engagement with the notches to allow the housing to be moved downward along the shaft.

19. The mount for an LED lighting assembly of claim 16, wherein:

the housing comprised an airflow intake port and an air flow exhaust port, and at least one airflow channel within the housing around the at least one LED, and wherein the airflow intake port and the airflow exhaust port are configured so that heat produced by the at least one LED creates an airflow such that air from outside the housing is drawn into the air flow intake port, through the at least one airflow channel, and out of the air flow exhaust port.

* * * * *